US006082851A

United States Patent [19]

Shihoh et al.

[11] Patent Number: 6,082,851

[45] Date of Patent: Jul. 4, 2000

[54] LIQUID EJECTION PRINTING APPARATUS AND LIQUID SUPPLY METHOD TO BE EMPLOYED IN THE SAME

[75] Inventors: Makoto Shihoh, Yokohama; Akihiro Mouri, Fuchu; Masataka Yashima, Tokyo; Noriyuki Chino, Kawasaki; Yasuyuki Takanaka, Urawa; Yoshimasa Araki, Kawaguchi, all of Japan

[73] Assignee: Canon Kabushiki Kaisha, Tokyo, Japan

[21] Appl. No.: 09/190,102

[22] Filed: Nov. 12, 1998

[30] Foreign Application Priority Data

| | | | |
|---|---|---|---|
| Nov. 14, 1997 | [JP] | Japan | 9-314050 |
| Dec. 29, 1997 | [JP] | Japan | 9-368898 |
| Mar. 13, 1998 | [JP] | Japan | 10-063473 |
| Jun. 8, 1998 | [JP] | Japan | 10-159558 |

[51] Int. Cl.[7] ..... B41J 2/175

[52] U.S. Cl. ..... 347/85

[58] Field of Search ..... 347/89, 85, 84

[56] References Cited

U.S. PATENT DOCUMENTS

| | | | |
|---|---|---|---|
| 4,340,896 | 7/1982 | Cruz-Uribe et al. | 347/85 |
| 4,380,770 | 4/1983 | Maruyama | 347/29 |
| 4,462,037 | 7/1984 | Bangs et al. | 347/85 |
| 4,680,696 | 7/1987 | Ebinuma et al. | 347/85 |
| 5,159,348 | 10/1992 | Dietl et al. | 347/89 |
| 5,943,078 | 8/1999 | Nishimoto et al. | 347/89 |

FOREIGN PATENT DOCUMENTS

| | | |
|---|---|---|
| 803 362 | 10/1997 | European Pat. Off. . |
| 57-199664 | 12/1982 | Japan . |
| 10-6521 | 1/1998 | Japan . |

*Primary Examiner*—N. Le
*Assistant Examiner*—Michael Nghiem
*Attorney, Agent, or Firm*—Fitzpatrick, Cella Harper & Scinto

[57] ABSTRACT

A liquid ejection printing apparatus performing printing by ejecting a liquid toward a printing medium includes a liquid ejection head portion having a liquid ejecting printing head ejecting a liquid and a first tank holding the liquid to be supplied to the head, a second tank holding a liquid to be supplied to the first tank and having an atmosphere communicating opening for introducing an atmospheric air, a third tank receiving the liquid from the first tank and capable of supplying the liquid to the second tank, a first liquid supply passage for communicating the first tank and the second tank, a second liquid supply passage for communicating the second tank and the third tank, a third liquid supply passage for communicating the third tank to the first tank, the first tank and the third tank each forming an enclosed space excluding supply passages connected respectively thereto, a pump capable of sucking a gas within the third tank provided in a passage other than the first, second and third supply passages and a first valve provided in the second supply passage for opening and closing the second liquid supply passage, and a second valve provided in the third tank for communicating the gas within the third tank to outside.

20 Claims, 27 Drawing Sheets

LIQUID EJECTION PRINTING APPARATUS AND LIQUID SUPPLY METHOD TO BE EMPLOYED IN THE SAME

This application is based on Patent Application Nos. 314050/1997 filed on Nov. 14, 1997 in Japan, 368898/1997 filed on Dec. 29, 1997 in Japan, 63475/1998 filed on Mar. 13, 1998 in Japan, and 159558/1998 filed on Jun. 8, 1998 in Japan, the content of which is incorporated hereinto by reference.

BACKGROUND OF THE INVENTION

1. Field of the Invention

The present invention relates generally to a liquid ejection printing apparatus and a liquid supply method to be employed in the same. More particularly, the invention relates to a liquid ejection printing apparatus in a technical field of an ink-jet printing, in which a large amount of ink is used and a circulation path of the ink is provided, and a liquid supply method employed in the liquid ejection printing apparatus.

2. Description of the Related Art

Conventionally, an ink-jet printing apparatus performing printing on a medium to be printed, such as a paper by ejecting an ink droplet from a printing head, has been spread as a printer connected with personal computer, a facsimile machine, a copy machine.

The ink-jet printing apparatus is advantageous for capability of high speed and low noise printing of high quality image, and for easiness of color printing. In the recent years, the ink-jet printing apparatus is also used for apparatus having large printing volume, such as printing on a large size paper, such as poster output, textile printing performing printing on a cloth, and so on.

On the other hand, study has been made for application of the ink-jet printing to a multi-tone image printing for medical use, such as X-ray film, CT-scan image and so on. In such medical image printing apparatus, it becomes possible to express much greater variety of tones than number of kinds of ink by combining a plurality of kinds of inks having different densities and performing printing for two or three times.

Here, since ink-jet printing apparatus performs printing by ejecting inks, it becomes necessary to constantly supply ink consumed by ejection.

As an ink supply system for the printing head, in case of the known apparatus for respective application consuming large amount of ink, a large volume tank is integrally mounted on a main body in the apparatus and an ink passage from the tank to the head cartridge is formed with a pipe, such as a tube.

As a flexible tube to be employed in the ink passage, a tube formed of rubber or resin has certain gas permeability. Therefore, air in the atmosphere may penetrate into the tube through a tube wall in bit by bit to cause bubble therein. When the bubble flows into the printing head, normal ejection of the ink droplet becomes impossible to cause printing failure in the worst case.

Therefore, there has been proposed an ink circulation passage as shown in FIG. 1 which prevents the bubble from entering into the printing head even when the bubble is generated.

In FIG. 1, the reference numeral 501 denotes a printing head, 502 denotes an air buffer chamber, 503 denotes an ink tank. The air buffer chamber 502 and the ink tank 503 are connected through two ink passages 504 and 505 to form a circulation passage. In a flow path of the ink passage 505, a pump 506 is provided to transfer the ink within the air buffer chamber 502 to the ink tank 503. On the other hand, the air buffer chamber 502 is enclosed structure with respect to atmosphere except for the two ink passages. To the ink tank 503, an atmosphere communication opening 507 is provided.

In the foregoing ink circulation passage, when the pump is driven, the ink and air within the air buffer chamber 502 is transferred into the ink tank 503 through the ink passage 505. In conjunction therewith, the ink in the ink tank 503 is fed to the air buffer chamber 502 through the ink passage 504. By performing ink circulation between the air buffer chamber 502 and the ink tank 503, bubble generated in the ink passage can be discharge into the ink tank 503 to successfully prevent the bubble from penetrating into the head.

However, in the foregoing construction, the following technical problems have been encountered in view point for performing further printing of higher tone and higher image quality image at higher speed.

Namely, when the pump 506 is provided within the ink circulation passage, the ink passes through the inside of the pump to cause difficulty of certainly removing dust generated within the pump (for example, in case of a tube pump, worn chip of the inside of the tube caused due to repeated drawing of the same position of the tube or fat and oil component contained in the material of the tube). Such dust can cause plugging if deposited on the nozzle in the printing to be solidified therein. Particularly, when the diameter of the ejection openings or nozzles are made smaller in order to realize high image quality, certain removal of the dust is required.

In commonly owned Japanese Patent Application Laid-open No. 6521/1998, there has been proposed a liquid supply method and a light supply apparatus for easily and certainly perform supply of the liquid into the liquid supply path with solving the problem in removing dust in the ink supply passage in one direction, by providing a mechanism for feeding the ink independent of the ink supply passage.

SUMMARY OF THE INVENTION

Therefore, it is an object of the present invention to provide a liquid ejection printing apparatus having a circulation passage for preventing bubble from penetrating into a printing head and a liquid supply method in the apparatus, in which admixing of impurity in the ink within the ink circulation passage can be prevented by providing a mechanism for feeding an ink independently of the ink circulation passage.

Another object of the present invention is to enable switching between ink circulation in the ink circulation passage and supply of ink to an ink tank, with simple mechanism.

A further object of the present invention is to provide a liquid supply method which can realize high speed printing by enabling printing operation during supplying of ink, in addition to the foregoing object or alone.

According to one aspect of the invention, there is provided a liquid ejection printing apparatus performing printing by ejecting a liquid toward a printing medium comprising a liquid ejection head portion having a liquid ejecting printing head ejecting a liquid and a first tank holding the liquid to be supplied to the head, a second tank holding a liquid to be supplied to the first tank and having an atmosphere communicating opening for introducing an atmospheric air, a third tank receiving the liquid from the first tank and capable of supplying the liquid to the second tank, a first liquid supply passage for communicating the first tank and the second tank, a second liquid supply passage for communicating the second tank and the third tank, a third liquid supply passage for communicating the third tank to the first tank, the first tank and the third tank forming an enclosed space excluding a supply passage connected respectively, a pump capable of sucking a gas within the third tank provided in a passage other than the first, second and third supply passages and a first valve provided in the second supply passage for opening and closing the second liquid supply passage, and a second valve provided in the third tank for communicating the gas within the third tank to outside.

According to another aspect of the invention, there is provided a liquid supply method for supplying a liquid to the foregoing liquid ejection printing apparatus comprising a first liquid supply step of closing the first and second valves and sucking a gas of the third tank by the pump for introducing a liquid within the first tank to the third tank, and a second liquid supply step of opening the first and second valves for introducing the liquid within the third tank to the second tank.

With the liquid ejection printing apparatus and the liquid supply method according to the present invention, the liquid stored in the third tank can be circulated through the second tank, the first tank and the third tank through a circulation passage including the second liquid supply passage, the first liquid supply passage and the third supply passage. Upon circulation of the liquid, the gas within the third tank is sucked by the pump. By providing the pump within the passage different from the circulation passage, impurity will never be admixed to the ink within the ink circulation passage.

According to another aspect of the invention, there is provided the foregoing liquid ejection printing apparatus further comprising a fourth tank supplying a liquid to the third tank and a fourth liquid supply passage communicating the third tank and the fourth tank, and the pump is provided in the passage other than the fourth liquid supply passage.

With the construction set forth above, upon performing circulation of the liquid, the liquid is filled from the fourth tank to the third tank, a common pump can be used with simple mechanism with only switching of the valve.

According to another aspect of the invention, there is provided a liquid supply method for supplying a liquid to a liquid ejection printing apparatus as one preferable embodiment of the present invention, the apparatus having a fourth tank, a third tank for blocking movement of the liquid arranged at any one of a first liquid passage and a third liquid passage, a first liquid supply step of closing the first and second valves and sucking a gas within the third tank for introducing the liquid within the first tank into the third tank, a second liquid supply step of opening the first and second valves and introducing the liquid within the third tank into the second tank, and a third liquid supply step of closing the first, second and third valves, sucking a gas within the third tank by the pump and introducing the liquid within the fourth tank into the third tank, wherein the third liquid supply step is performed during printing operation to the printing medium.

With the liquid supply method set forth above, since liquid supply from the fourth tank to the third tank is completed during printing operation, throughput of printing can be improved to realize high speed printing.

The above and other objects, effects, features and advantages of the present invention will become more apparent from the following description of embodiments thereof taken in conjunction with the accompanying drawings.

BRIEF DESCRIPTION OF THE DRAWINGS

FIGS. 9A and 9B are explanatory illustrations of the third embodiment of the ink-jet printing apparatus according to the present invention, in which FIG. 9A is a top plan view of the ink-jet printing apparatus and FIG. 9B is a front elevation of the ink-jet printing apparatus as viewed in a direction of arrow A in FIG. 9A;

FIGS. 10A and 10B are explanatory illustrations of the third embodiment of the ink-jet printing apparatus of the present invention, in which FIG. 10A is a section taken along line B–B' of FIG. 9B, and FIG. 10B is a section of the major portion of the ink-jet printing apparatus shown in FIGS. 9A and 9B;

DESCRIPTION OF THE PREFERRED EMBODIMENT

Preferred embodiments of a liquid ejection printing apparatus according to the present invention will be explained hereinafter.

First Embodiment

Figure 2:
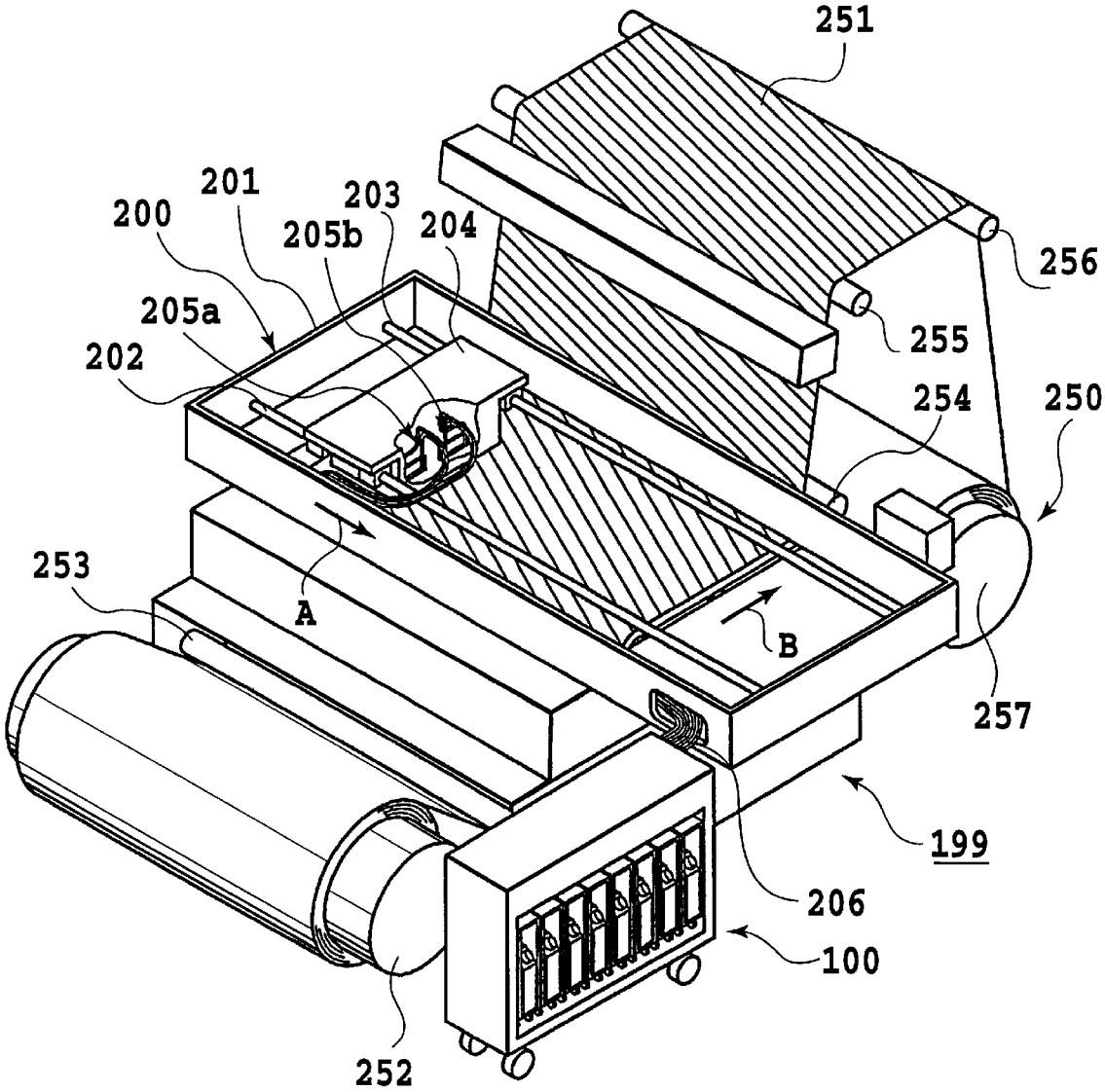
FIG. 2 is a respective view showing an external appearance of a color textile printing system as one embodiment of a liquid ejection printing apparatus according to the present invention.

FIG. 2 is a perspective view of a color textile printing system as one embodiment of a liquid ejection printing apparatus according to the present invention.

An ink-jet printing apparatus main body 199 is generally constructed with an ink supply portion 100, a printer portion 200 and a cloth transporting portion 250.

A cloth 251 as a printing medium is set on a cloth supply roller 252 in a form of roll. The cloth 251 is transported by rollers 252 to 257 forming a transporting portion 250.

On a printer frame 201 located above the cloth transporting portion 250, two guide rails 202 and 203 are supported and fixed in mutually parallel relationship along a direction of arrow A. A carriage 204 is movably supported on two guide rails 202 and 203 for movement in the direction of arrow A. On the carriage, a plurality of printing heads (only printing heads 205*a* and 205*b* are illustrated as representative) are provided in opposition to the cloth 251.

When the carriage 204 is moved by a driving motor (not shown) in the direction of arrow A, ink ejection command is output to the printing heads 205*a* and 205*b*, for example, as required for performing printing. After completion of motion of the carriage 204, one line of printing corresponding to the ejected ink is performed at a predetermined position on the cloth 251. After performing printing for one line on the cloth 251, the cloth 251 is transported for a predetermined amount in a direction of arrow B (auxiliary scanning direction) of FIG. 2 by a cloth feeding belt (not shown). Next, with performing ejection by the printing heads 205*a* and 205*b* as required, a second line is printed on the cloth 301 when the carriage 204 is moved in the direction of arrow A. With repeating such sequence of operation, a desired sequential print is performed on the cloth 301.

It should be noted that an ink tube group 206 is connected to the printing heads 205*a* and 205*b*, for example so that inks in amounts corresponding to consumed amounts are supplied to the printing heads 205*a*, 205*b* and so on from the ink supply portion 100 via the ink tube group 206, every time of repeating ejection.

Next, a construction of the ink supply portion 100 of the liquid ejection printing apparatus set forth above will be explained with reference to FIG. 3.

The ink supply portion 100 is generally constructed with a first ink tank 2 storing an ink to be supplied to the printing head 205*a* (or 205*b*), a second ink tank 4 supplying the ink to the first ink tank 2 and a third ink tank 5 supplying the ink to the second ink tank 4 and storing the ink overflowed from the first ink tank 2.

The first ink tank 2 is mounted on the carriage 204 which is movable with respect to a main body in the apparatus forming the foregoing system, together with the foregoing printing head 205*a* (or 205*b*). On the other hand, the second ink tank 4 and the third ink tank 5 are fixed on the main body forming the foregoing system.

The first ink tank 2 and the second ink tank 4 are connected through a first ink passage 6. One end of the first ink passage 6 is connected to a lower portion of the first ink tank 2, and the other end of the first ink passage 6 is connected to the lower side portion of the second ink tank 4. On the lower side portion of the second ink tank 4, a liquid level sensor 24 serving as ink level detecting means for detecting an ink level (liquid level) in the second ink tank 4 is arranged at a position higher than the connecting position of the first ink passage 6. It should be noted that an atmosphere communication hole 26 is provided at the upper portion of the second ink tank 4.

The bottom portion of the second ink tank 4 and the bottom portion of the third ink tank 5 are connected by a second ink passage 8. At an intermediate position of the second ink passage 8, a first valve 9 is provided.

In an upper portion of the third ink tank 5 an atmosphere communication passage 11 is provided. At the intermediate position of the atmosphere communication passage 11, a second valve 10 for switching for establishing and blocking communication with the atmosphere, is mounted. On a side portion of the third ink tank 5, one end of a third ink passage 7 for collecting an ink overflowed from the first ink tank 2, is connected. At the intermediate position of the ink passage 7, a third valve 22 is mounted. On the other hand, in the upper portion of the third ink tank 5, one end of an air chamber suction passage 12 for sucking air of a air chamber portion therein is connected. The other end of the air chamber suction passage 12 is connected to a waste ink tank 13. At an intermediate position of the air chamber suction passage 12, a tube pump 50 is arranged.

Figure 3:
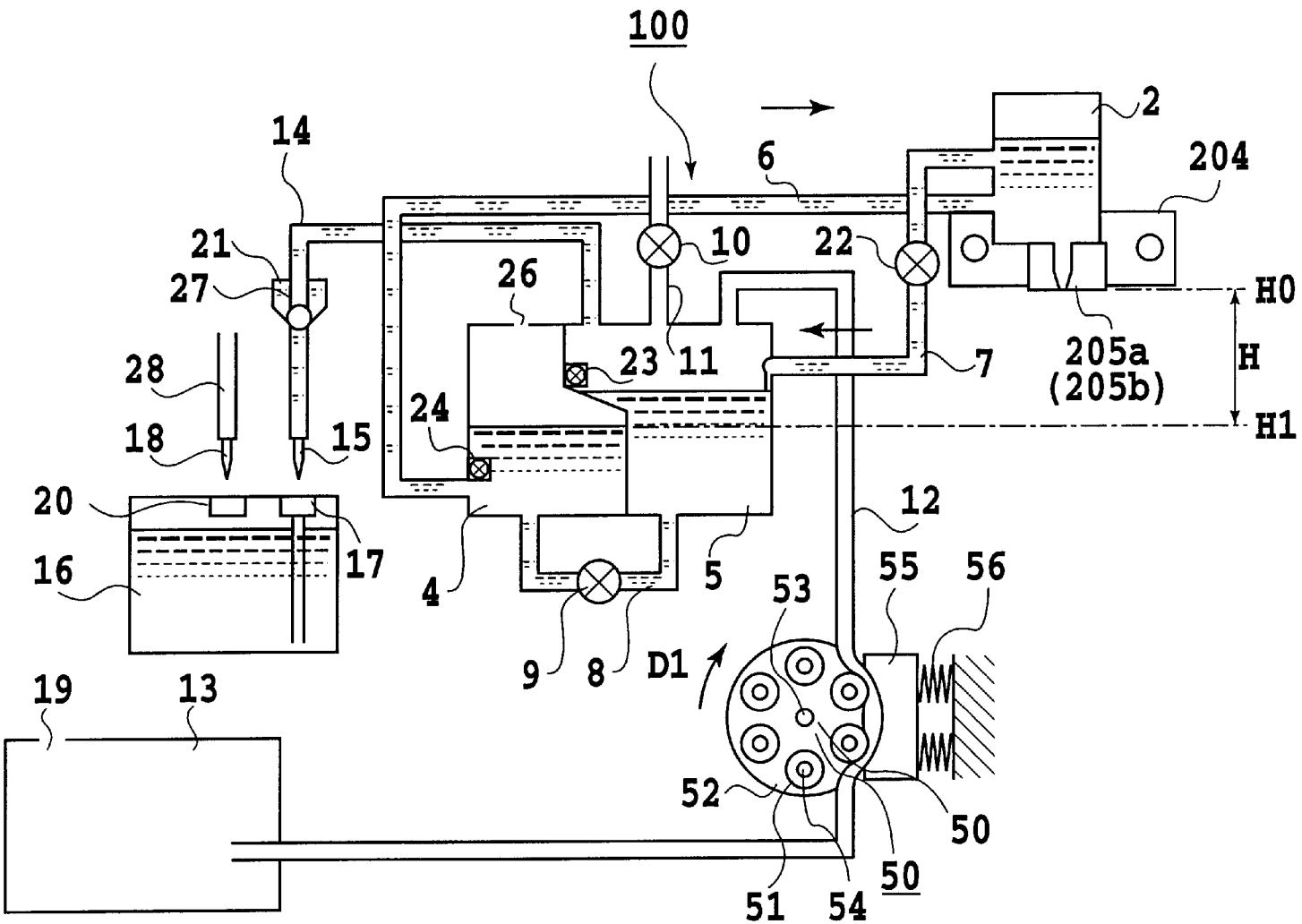
FIG. 3 is an explanatory illustration for explaining a construction of an ink supply portion in the first embodiment of the liquid ejection printing apparatus according to the present invention.

In FIG. 3, six rollers 51 of the tube pump 50 are arranged within a roller holder 52 in circumferential alignment. The roller holder 52 is supported rotatably about a rotation axis 53. The rollers 51 are also supported for rotatably about roller shafts 54 which are fixed on the roller holder 52. A depression member 55 is biased toward the roller 51 by a compression spring 56 for squeezing a tube 12 arranged on a part of outer peripheral portion of the roller holder 52 and extend on the outer peripheral edge of the latter. The roller holder 52 is driven by a not shown motor to rotate in a direction of arrow D1. Then, the rollers 51 perform orbital motion about the rotation axis 53 of the roller holder 52. Therefore, the tube 12 is drawn by a plurality of rollers 51 and the depression member 55 to such the air in the air chamber portion of the third ink tank 5, as will be explained later. It should be noted that since the air chamber suction passage 12 is introduced into the waste ink tank 13 having the atmosphere communication opening 19, even when the ink in the third ink tank 5 is discharged through the air suction passage 12, the ink will never leak out of the apparatus.

Here, in the shown embodiment, both of the atmosphere communication passage 11 and the air chamber suction passage are formed of flexible material. For example, a silicon tube is employed. The silicon tube does not require significant force for crushing or squeezing by the roller or the like and has reasonable restoring force not to cause plastic deformation even being crushed or squeezed for a long period, and not to cause alternation or denaturation of the ink. The first valve 9 and the second valve 10 are opened and closed by crushing the atmosphere communication passage 11 by means of a not shown cam member. By opening and closing the second valve 10, communication of the air chamber portion of the third ink tank 5 can be established and blocked.

On the other hand, the upper portion of the third ink tank 5 and an upper portion of a fourth tank, as a supply tank 16 for indirectly performing an auxiliary ink supply to the first ink tank 2 are connected by a fourth ink passage 14. To the intermediate position of the four ink passage 14, a check valve 21 as a fourth valve is mounted. To one end of the fourth ink passage 14, a first needle member 15 to be inserted into an ink supply opening 17 of the supply tank 16 is mounted. The first needle member 15 is a pipe form member formed with an aperture at its tip end. The atmosphere communication opening 20 of the supply tank 16 is opened to the atmosphere by the atmosphere communication passage 28. It should be noted that on one end of the atmosphere communication passage 28, a second needle member 18 in a pipe form with an aperture at the tip end is mounted. The second needle member 18 is inserted into the atmosphere communication opening 20.

On the other hand, in an inner wall portion of the third ink tank 5, a liquid level sensor 23 as an ink level detecting means is mounted at a position higher than the liquid level sensor 24 of the second ink tank. The ink level sensor 23 is adapted to detect a maximum ink level in the third ink tank 5 and the ink level sensor 24 is adapted to detect a minimum ink level in the second ink tank 4.

In the construction set forth above, a pressure of the first ink tank 2 adjacent the printing head is determined by an ink level H1 of the second ink tank 4. A height difference H between the level H0 of the ejection opening of the printing head and the level H1 of the second ink tank 4 is desired to be within a range of 20 to 100 mm in viewpoint of stability of ejection.

Here, operation of the shown embodiment of the liquid ejecting printing apparatus will be explained with reference to FIGS. 4A to 4D.

Figure 4A:
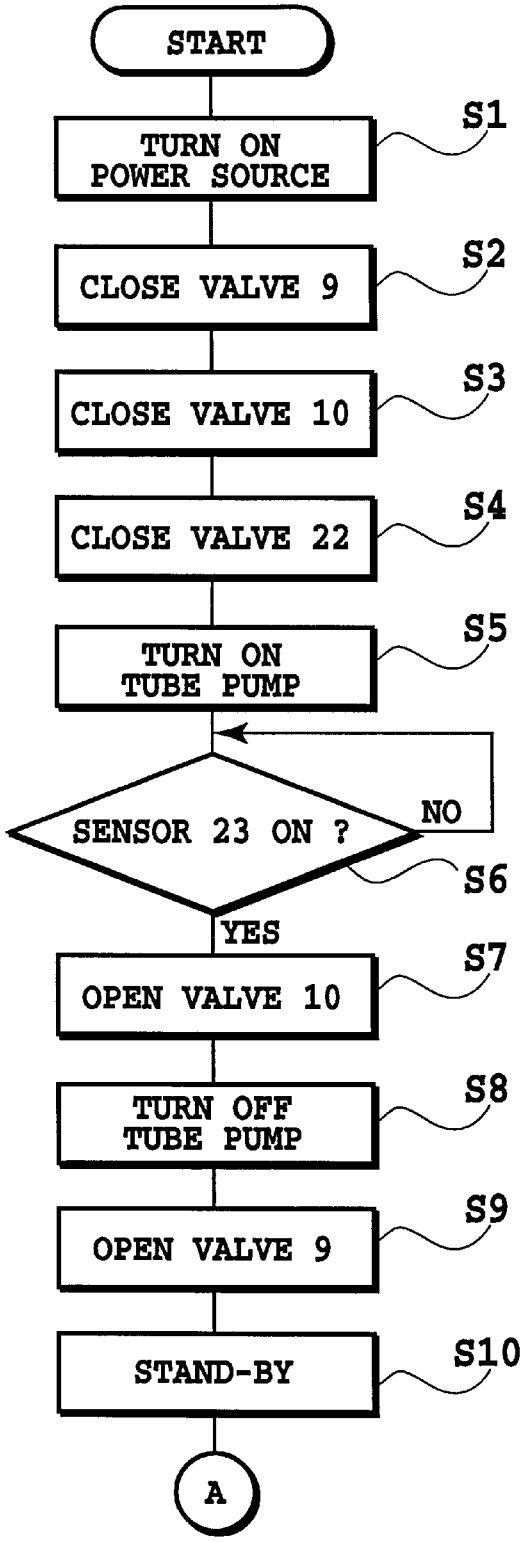
FIGS. 4A to 4D are flowcharts for explaining sequences relating to liquid supply in the first embodiment of the liquid ejection printing apparatus according to the present invention.

When a power source is turned ON, by a sequence shown in FIG. 4A, a liquid supply step from the fourth tank to the third tank and a liquid supply step from the third tank to the second tank are performed. It should be noted that, in the following explanation, "sensor ON" represents a condition of "ink present".

At first, after turning ON the power source, valves 9, 10 and 22 are closed (S2, S2 and S4). Then, driving of the tube pump 50 is initiated (S5), suction is made for the air in the air chamber portion of the ink tank 5 to lower the pressure therein. Then, due to reduction of the pressure in the air chamber portion of the ink tank 5, the ink in the supply tank 16 is filled in the ink tank 5 through the ink passage 14. When the ink level detecting means (sensor) 23 in the ink tank 5 detects the ink level (S6), the valve 10 is opened (S7) to return the pressure in the air chamber portion to the atmospheric pressure. After opening the valve 10, the tube pump 50 is stopped. At S8, the tube pump 50 is not required to be stopped since the valve 10 is held opened. However, in order to reduce power consumption, it is desirable to stop the tube pump 50.

Subsequently, when the valve 9 is opened (S9), the ink is transferred from the ink tank 5 to the ink tank 4 to levelize the ink. Here, levelization represents that the ink surfaces of both of the ink tanks 4 and 5 connected to each other so as not to be transferred between the tanks. Whether the inks in the ink tanks 4 and 5 are livelized completely is variable depending upon shape of the ink tanks 4 and 5, a diameter of the tube of the ink passage 8, a diameter of the tube of the valve 9. However, estimating the levelizing time, a signal of completing levelization based on a waiting time from a timing of opening of the valve 9 is fed to a not shown supply system control portion (S10).

Figure 4B:
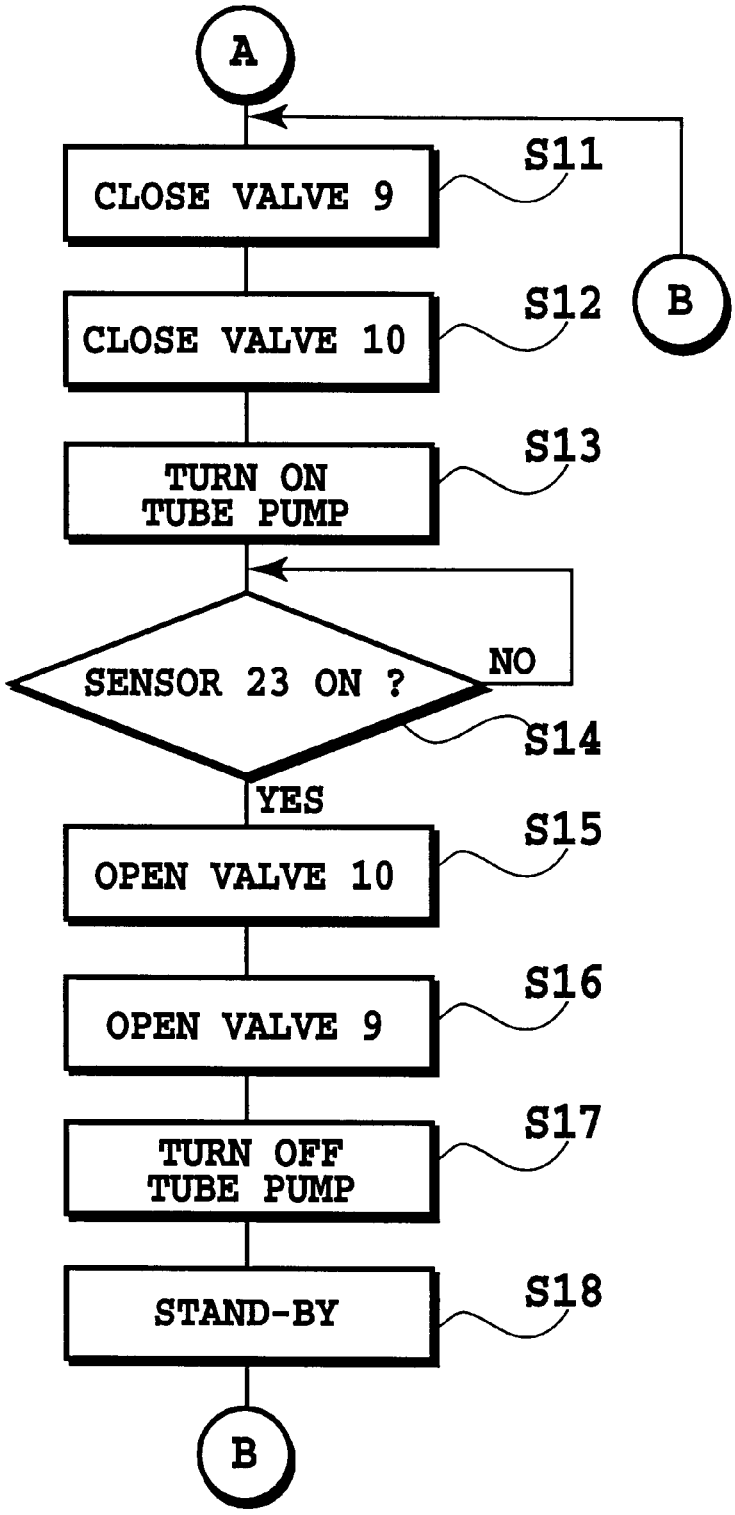

Next, as shown in FIG. 4B, upon reception of the signal, the supply system control portion closes the valves 9 and 10 (S11 and S12) to drive the tube pump 50 (S13) for sucking air from the air chamber portion of the ink tank 5 in the same operation as that upon filling the ink to the ink tank 5 as set forth above for lowering the pressure in order to such the ink in the supply tank 16 to fill the ink in the ink tank 5. When the ink level sensor 23 detects the ink (S14), the valves 10 and 9 are opened in sequential order (S15 and S16) to stop the tube pump 50 (S17). Then, a stand-by state is maintained for a given period (S18) for levelizing the ink.

Subsequently, as required, by repeating the foregoing operation for a plurality of times as shown in FIG. 4B, an ink surface of the ink tank 5 can be set in the vicinity of the ink level sensor 23. In the shown embodiment, the foregoing operation is repeated twice.

Figure 4C:
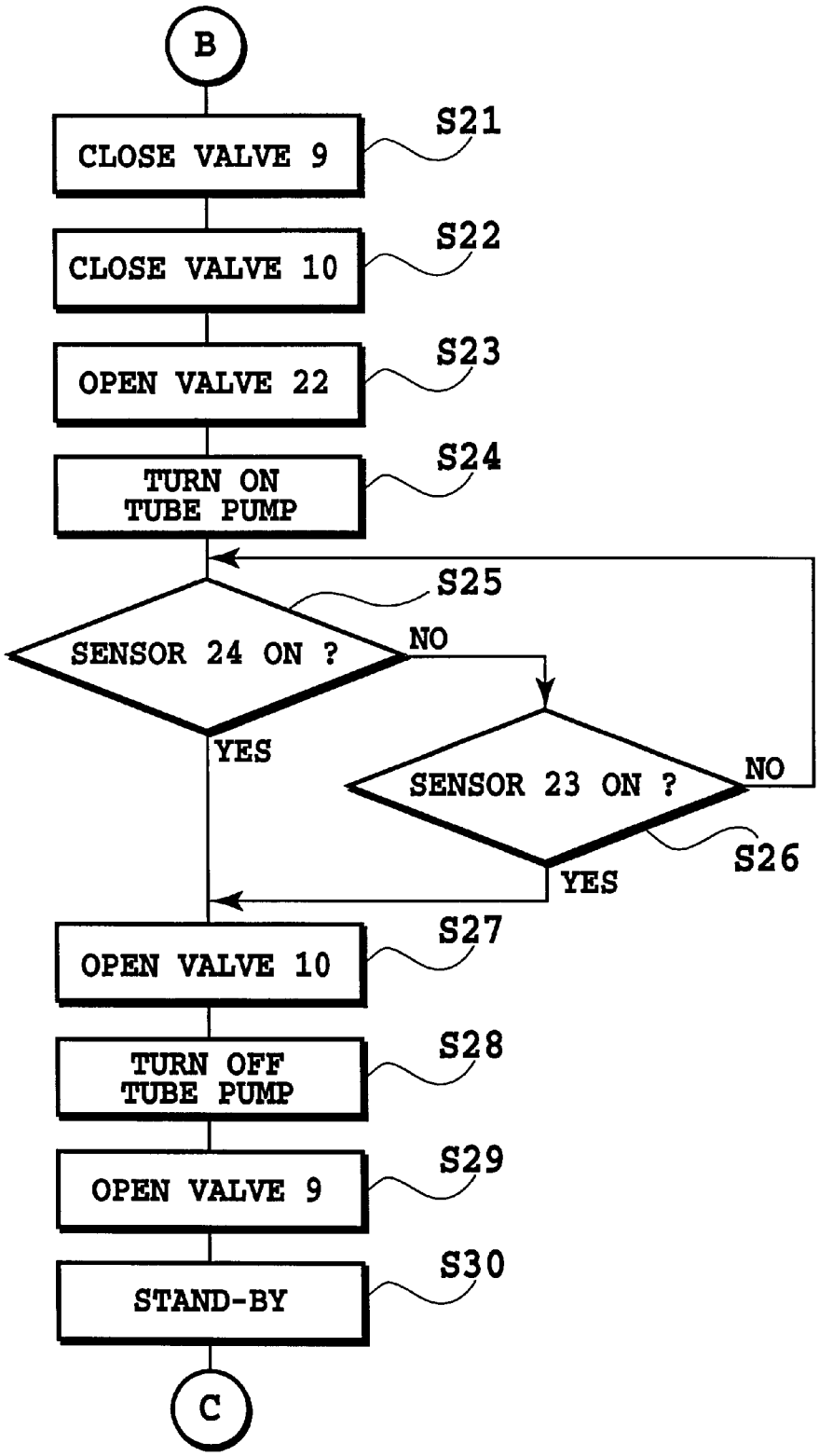

Next, as shown in FIG. 4C, an ink supply process from the second ink tank to the third ink tank through the first ink tank will be explained.

At first, after levelizing of ink within the ink tanks 4 and 5, valves 9 and 10 are closed (S21 and S22) and the valve 22 is opened (S23). Then, the tube pump 50 is driven (S24), the air in the air chamber portion of the ink tank 5 is sucked to lower the pressure in the ink tank 5 to lower the pressure within the ink tank 2. It should be noted that, at this time, since the ejection openings of the printing head 1 is closed by a not shown capping means, the air will never be introduced therethrough. As a result, the ink is supplied from the ink tank 4 into the ink tank 2 via the ink passage 6. When the ink is accumulated within the ink tank 2 to reach the connecting opening, the ink is introduced into the ink tank 5 via the ink passage 7 from the ink tank 2. Thus, the ink within the ink tank 4 moves into the ink tank 5 via the ink tank 2. Thus, all tanks can be filled.

At this time, so that the ink in the supply tank 16 will never flow into the third tank 5 via the fourth ink passage 14 by opening the fourth valve 21, the fourth valve 21 is biased in closing direction by an elastic member 27.

However, when the tube pump 50 is continuously driven, the ink in the ink tank 4 is continuously reduced and conversely, the ink in the ink tank 5 is continuously increased to cause overflow. Therefore, the foregoing operation is terminated when the ink level sensor 24 detects absence of the ink (S25) or when the level sensor 23 detects presence of the ink (S26). Then, the valve 10 is opened (S27) to return the pressure in the ink tank to the atmospheric pressure. Furthermore, driving of the tube pump 50 is stopped (S28) to open the valve 9 (S29). Then, stand-by state is maintained for a given period (S30) to perform levelizing of the ink to establish a condition capable of printing (S31). It is desirable to effect releasing of the not shown capping means after returning of the pressure within the ink tank 2.

Ink circulating operation of S21 to S30 is performed for removing bubble within the ink supply system upon turning ON of the apparatus or when ON state of power supply is maintained for a long period without performing printing.

Figure 4D:
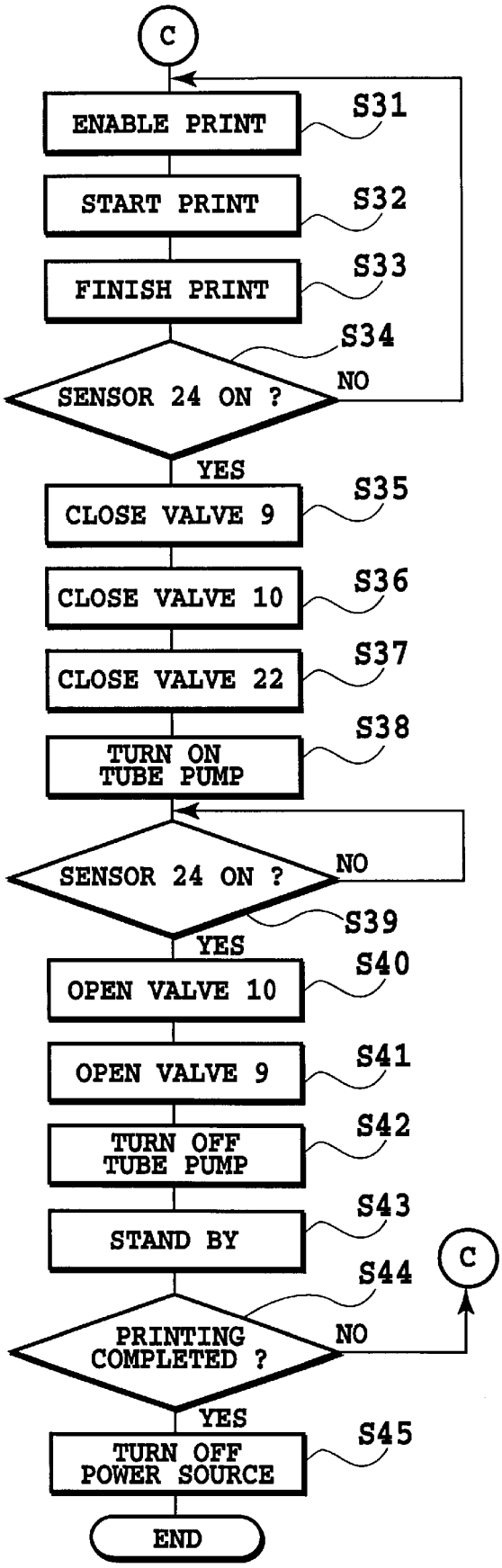

Subsequently, as shown in FIG. 4D, in response to a signal commanding print from a not shown computer, printing operation is performed (S32). When image printing is completed (S33), and if the ink level sensor 24 does not detect absence of the ink, printing condition is maintained. On the other hand, if the ink level sensor 24 detects absence of the ink (S34), ink supply operation for the ink tanks 4 and 5 is initiated.

In this operation, the valves 9, 10 and 22 are closed (S35, S36 and S37) and the tube pump 50 is driven (S38). Then, the air in the air chamber portion of the ink tank 5 is sucked for reducing pressure therein. As a result, the ink in the supply tank 16 is sucked and introduced into the ink tank 5. Thus, the ink tank 5 is filled. Once the ink level sensor 23 detects presence of ink (S39), the valves 10 and 9 are opened in sequential order (S40 and S41) and the tube pump 50 is stopped (S45) to terminate a sequence of ink supply operation.

When the printing apparatus is restarted for performing image printing, since the ink is already filled in respective ink tanks, stable printing with preventing penetration of bubble into the ink ejection nozzles can be performed by initiating ink circulating operation from the foregoing step S11 in order to remove bubble in the ink supply system.

On the other hand, if the ink level sensor 23 cannot detect the ink even after a given period despite of the sequence of the foregoing operation, it should be caused for spending out of the ink in the supply tank 16. Then, command is displayed for filling the ink in the supply tank 16 or for exchanging the supply tank 16 with one filled with the ink.

It should be noted that while the shown embodiment takes a sequence to initiate printing after ink circulating operation through steps S21 to S30, when a liquid feeding amount by the tube pump at step S24 is small, it is possible to take a sequence to perform printing during circulation of the ink since variation of the negative pressure in the ink tank 2 will not be significant. For instance, with setting the tube diameters and lengths of the ink passage 6 and the ink passage 7 so that the liquid feeding amount by the tube pump is 2 ml/min. and the negative pressure in the ink tank 2 is greater in the extent of 10 to 20 $mmH_2O$ (namely, equivalent to that the liquid surface of the ink tank 2 is lowered in the extent of 10 to 20 mm from the actual level), circulation of the ink and printing can be performed simultaneously with little influence for ejection of the ink.

Second Embodiment

Figure 1:
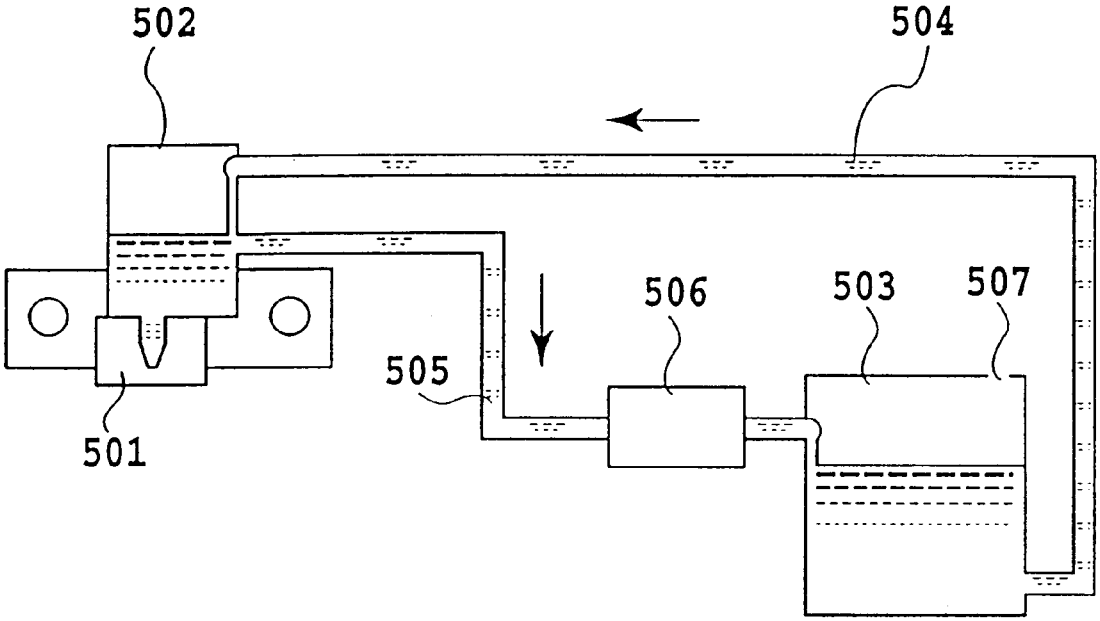
(PRIOR ART) FIG.1
FIG. 1 is an explanatory illustration showing one example of the conventional liquid ejection printing apparatus.
Figure 5:
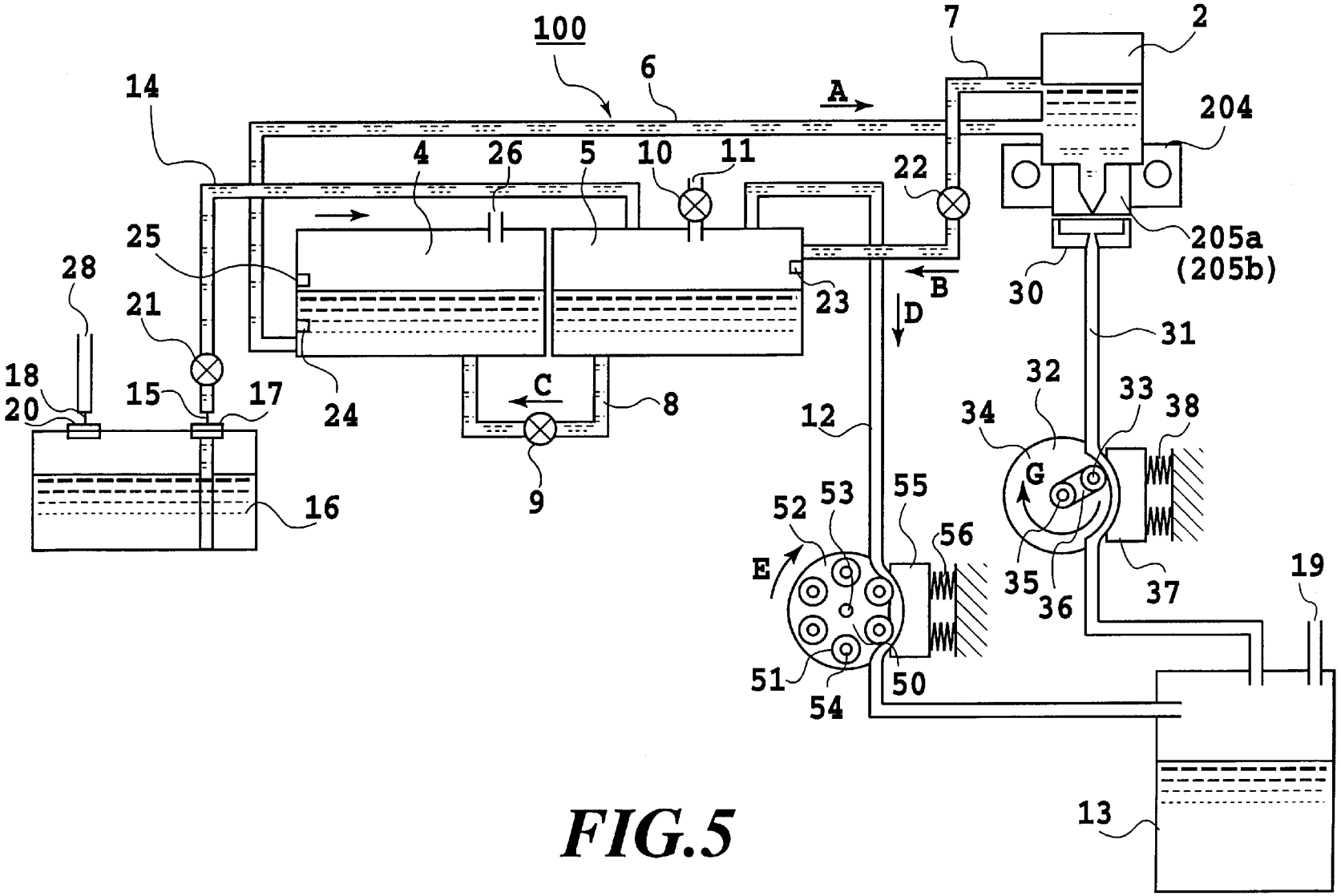
FIG. 5 is an explanatory illustration for explaining a construction of the ink supply portion of the second embodiment of the liquid ejection printing apparatus according to the present invention.

FIG. 5 is an explanatory illustration for explaining an ink supply portion 100 of the second embodiment of the liquid ejection printing apparatus according to the present invention. The shown embodiment is applicable for the liquid ejection printing apparatus shown in FIG. 1*b*, set forth above. Construction common to the foregoing first embodiment will be identified by the same reference numerals for avoiding redundant discussion for keeping the disclosure simple enough to facilitate clear understanding of the present invention.

In the shown embodiment of the second ink tank 4, the ink level sensor 24 and the ink level sensor are provided as the first detecting means. In the third ink tank 5, the ink level sensor 23 as the second detecting means is provided. The ink level sensor 24 detects a minimum ink level of the ink tank 4, the ink level sensor 25 detects a maximum ink level of the second ink tank 4, and the ink level sensor 23 detects a maximum ink level of the third ink tank 5. Here, the ink level sensor 25 is placed at a position lower than the ink level sensor 23.

In the drawing, the reference numeral 30 denotes a capping member prevents plugging due to drying of the ink by tightly fitted onto the nozzle surface of the printing heads 205*a* (205*b*) when the carriage 204 is stopped at a position normally called as home position out of the printing region of the carriage 204.

Here, a detailed description will be given hereinafter with respect to a capping means constituted of a capping member 30 and means associated therewith.

The capping means is supported by a not shown cap support member and has a mechanism to place the capping member 30 at positions for contacting with and releasing from the printing head 205*a* (205*b*). Furthermore, to the cap member 30, one end of the tube 31 is mounted for communication with the atmosphere. The other end of the tube 31 is connected to the upper portion of the waste ink tank 13.

Figure 8:
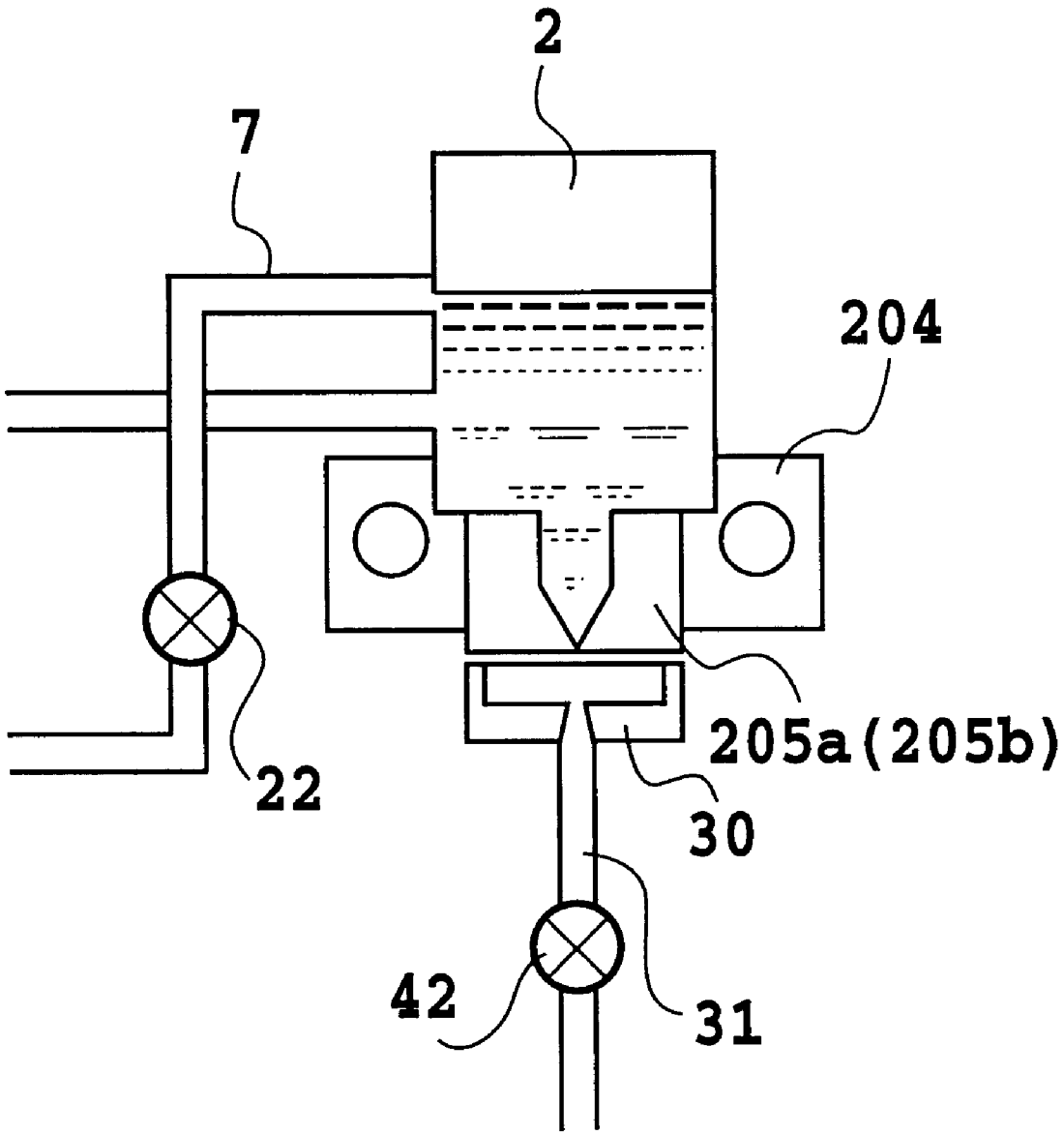
FIG. 8 is an explanatory illustration showing the major part of a modification of the second embodiment of the liquid ejection printing apparatus according to the present invention.

A reason why a condition communicating with the atmosphere is established in the capping member 30 using the atmosphere communication opening 19 is that the air within the cap will not be forced into the nozzles of the printing head 205*a* (205*b*) when the capping member 30 is contacted with printing head 205*a* (205*b*). In place, as shown in FIG. 8, a valve 42 may be provided for adjusting a pressure within a gap defined in the capping member 30 by the nozzle surface of the head 205 (206*b*) and the capping member 30.

In the tube 31, a suction pump 32 having both of a valve function and an ink suction function is provided. The reference 33 denotes a tube pressurizing roller which is rotatably supported on an arm 36 pivotable about a pivot shaft 35 for pivotal movement in a direction of arrow G. Closing of the tube 31 is realized by stopping the pressurizing roller 33 at a position crushing or squeezing the tube 31. A pushing member 37 is constantly biased toward the pressurizing roller by means of a compression spring 38 for crushing the tube 31 while the pressurizing roller is maintained at a position for closing the tube 31.

Next, a sequence of liquid supply in the shown embodiment will be explained with reference to FIGS. 6A to 6D and 7.

Figure 6A:
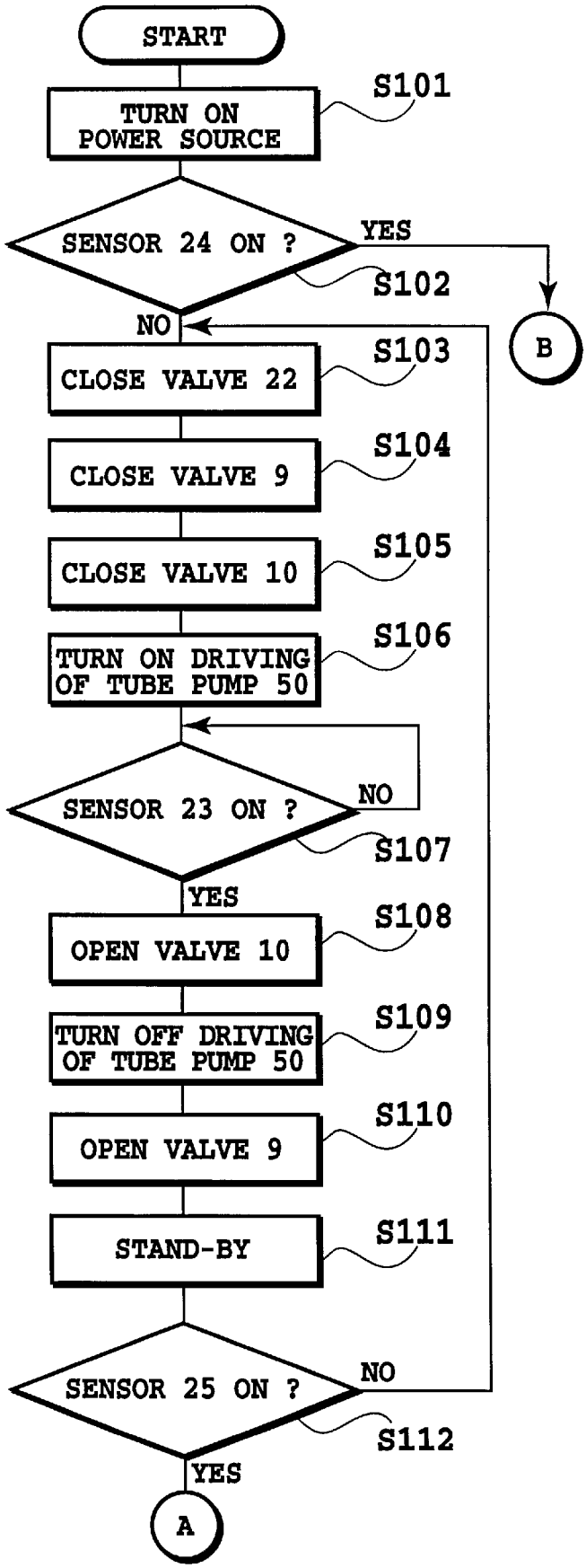
FIGS. 6A to 6D are flowcharts for explaining sequences relating to liquid supply in the second embodiment of the liquid ejection printing apparatus according to the present invention.

At first, as shown in FIG. 6A, upon turning ON the power source (S101), the ink level sensor 24 provided in the second ink tank 4 detects whether ink is present in the ink tank 4 or not (S102). If ink is not detected by the ink level sensor 24, an initializing operation for filling the ink which will be described hereinafter, is initiated.

After closing valves 22, 9 and 10 in sequential order (S103, S104 and S105), the tube pump 50 is driven (S106) to suck the air within the air chamber portion of the third ink tank 5 for reducing the pressure therein. Then, the ink in the supply tank 16 is introduced into the third ink tank 5 through the tube 14. When the ink level sensor 23 within the third ink tank 5 detects the ink level (liquid level) (S107), the valve 10 is opened (S108) to return the pressure within the third ink tank 5 to the atmospheric pressure. Alter opening the valve 10, driving of the tube pump 50 is stopped (S109).

Next, when the valve 9 is opened (S110), the ink is transferred from the third ink tank 5 to the second ink tank 4 for levelizing the ink.

A condition where the ink in the second ink tank 4 and the third ink tank 5 is levelized completely, is variable depending upon shapes of the second ink tank 4 and the third ink tank 5, a tube diameter of the tube 8, a tube diameter of the valve 9. In the shown embodiment, a period required for levelization is estimated so that a signal indicative of completion of levelizing is transmitted to the supply system control portion on the basis of a waiting period from a timing of opening of the valve 9 (S111).

When the ink level sensor 25 of the second ink tank 4 detects the ink (S112), the process moves to circulating operation to fill the ink within the first ink tank 2 and removing the bubble within the tube. Even when the ink cannot be detected by the ink level sensor 25 even by the levelizing operation, the process is returned to step S103 to repeat levelizing operation after again filling the ink to the third ink tank 5 (S103 to S111) until the ink is detected by the ink level sensor 25 (S112).

Figure 6B:
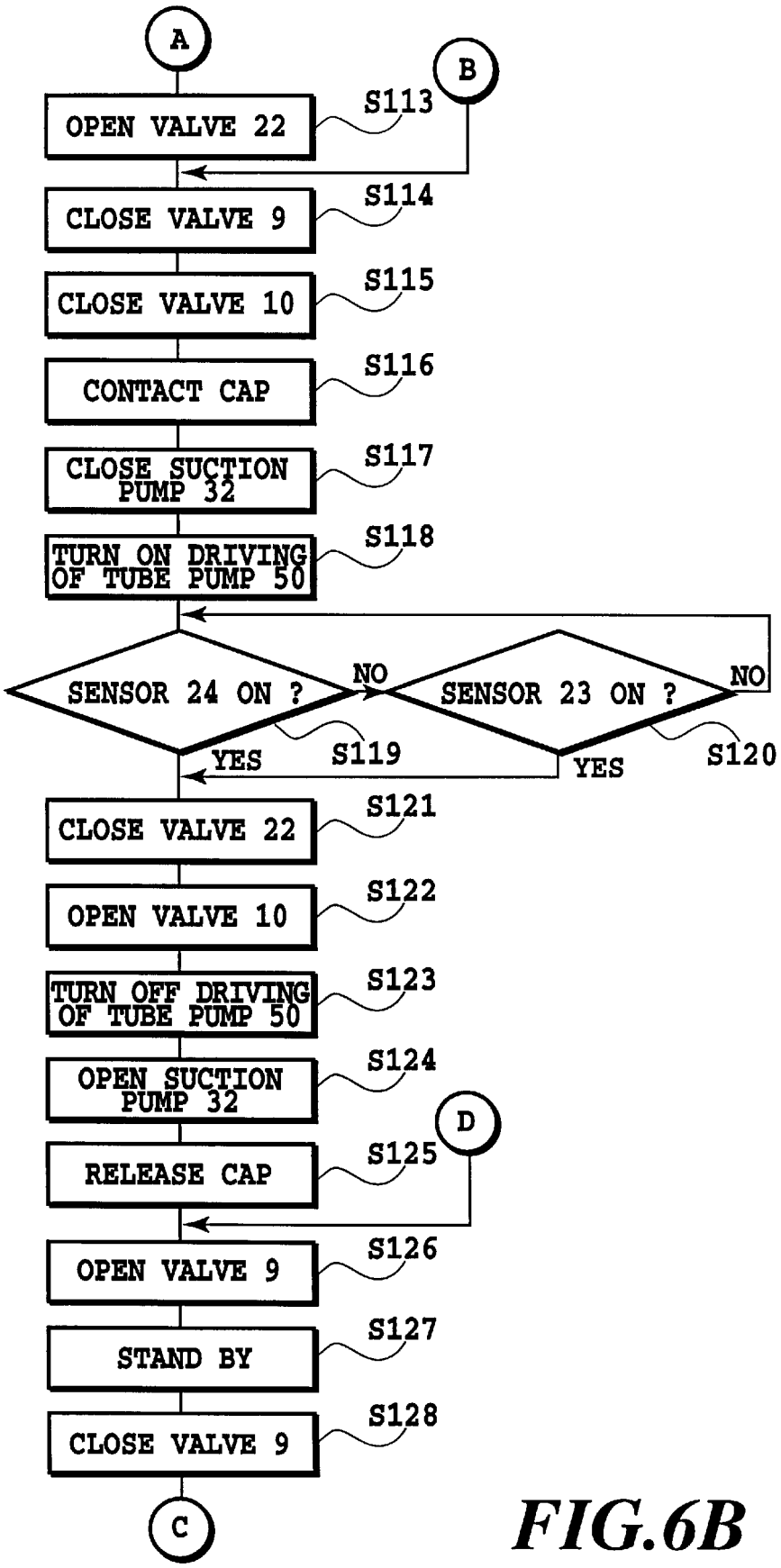

Next, filling of the ink in the first ink tank 2 will be explained with reference to FIG. 6B.

At first, after detection of the ink by the ink level sensor 25 (S112), the valve 22 is opened (S113) and also the valves 9 and 10 are closed (S114 and S115). At this time, in order to avoid penetration of the bubble from the nozzles of the printing head 205*a* (205*b*), the capping member 30 of the printing head 205*a* (205*b*) performs contacting operation to contact with the printing head 205*a* (205*b*) (S116). Then, by driving the suction pump 32, the tube 31 is crushed by the pressurizing roller 33 to place the tube in closed condition (S117). When the tube pump 50 is driven (S118), the air in the air chamber position of the third ink tank 5 is sucked. At the same time, the ink in the first ink tank 2 is sucked via the tube 7 and further the ink in the second ink tank 4 is sucked via the tube 6.

As set forth above, by sucking the ink in the third ink tank 5 by the tube pump 50, the ink in the second ink tank 4 is transferred to the first ink tank 2 and the third ink tank 5 to fill the ink for all of the tanks.

The foregoing operation is stopped when the ink level sensor 24 of the second ink tank 4 detects "ink is absent" (S119) or when the ink level sensor 23 of the third ink tank 5 detects "ink is present" (S120). Thereafter, after closing the valve 22 (S121), the valve 10 is opened (S122) to return the pressure in the third ink tank 5 to the atmospheric pressure. Furthermore, driving of the tube pump 50 is stopped (S123), then, the suction pump 32 is driven and the tube is opened to the atmosphere (S124). Then, cap 30 is released from the printing head 205*a* (205*b*) (S125). The valve 9 is opened (S126). After waiting for a given period (S127), levelization of the ink is performed. When levelization of the ink is completed, a condition capable of performing printing (stand-by state for printing) is established by closing the valve 9 (S128). Then, a print stand-by signal is transmitted to the not shown ink supply system control portion (S129).

After print stand-by state is established (S129), it becomes possible to select termination of printing or continuation of printing (S130). When printing is to be terminated and apparatus is to be stopped, an ink supply system terminating operation for quickly transit to the printing operation upon starting up of the printing apparatus at the next time, is performed. When printing is to be continued, a remaining amount of the ink in respective ink tanks is detected to control the ink supply system for constantly placing the printing head 205*a* (205*b*) in a state for enabling printing depending upon presence and absence of the ink in the make-up tank 16 and presence and absence of the ink in the second and third ink tanks 4 and 5, in stable condition.

Here, driving operation of the ink supply system for the case where printing is performed continuously, will be explained in detail.

In the shown embodiment of the printing apparatus, printing of the image on a printing medium is performed (S131) is performed by driving the printing head 205*a* (205*b*) by an image signal of a printing command from a computer as a not shown ejection control means. After termination of image printing (S132), a timer for detecting presence and absence of the ink in the supply tank 16 is reset (S133) and then re-started (S134). Then, judgement is made whether the ink is present or absent in the third ink tank 5 by the ink level sensor 23 (S135). When presence of the ink is detected, the process is advanced to step S136. At step S136, judgement whether the presence or absence of the ink in the second ink tank 4 is made by the ink level sensor 24. If absence of the ink is detected, levelization is performed returning step S126 to supply the ink in the second ink tank 4.

When the ink level sensor 24 of the second ink tank 4 detects presence of the ink (S136), the print stand-by state is established (S129).

When the ink is not filled in the third ink tank 5 as a result of judgement whether the ink is present or absent in the third ink tank 5 by the ink level sensor 25 at step S135, and if a period sufficient for supplying and filling the ink, the process is returned to step S135. When the ink level sensor 23 does not detect the ink even after elapse of the sufficient period for supplying and filling the ink, a time out is judged (S137). In this case, time out as judged at step S137 represents spending out of the ink in the ink supply tank 16. Therefore, "ink spent out" is displayed on a not shown display panel of the printing apparatus or on a computer connected to the printing apparatus (S138).

Furthermore, at this condition, the ink level sensor 24 of the second ink tank 4 makes judgement whether the ink is present or not (S139). If absence of the ink is detected, the process is advanced to step S149 to stop all of driving (S150 to S153). Then, the power source for the printing apparatus is turned OFF. The ink level sensor 24 of the second ink tank 4 detects presence of the ink (S139). Then, the printing apparatus returns to the print stand-by state (S129).

Assuming that a volume from the end portion of the tube 6 of the second ink tank 4 to the sensor level surface is set for certainly maintain the minimum ink amount to be consumed for printing one printing medium even when the ink level sensor 24 detects absence of the ink during printing, as necessary amount, spending out of the ink of the second ink tank 4 can be successfully prevented and, in turn, penetration of the bubble into the tube can be successfully prevented. In the ink supply method according to the present invention, it becomes necessary that the ink level sensor 23 of the third ink tank 5 continuously detect presence of the ink from completion of printing to transition to the printing stand-by state.

In order to realize this condition, at the same time of outputting of the print stand-by signal from the not shown ink supply system control portion (S129), detection whether the ink is present in the third ink tank 5 or not is made so that the operation for filling the third ink tank 5 is initiated if not filled.

Figure 7:
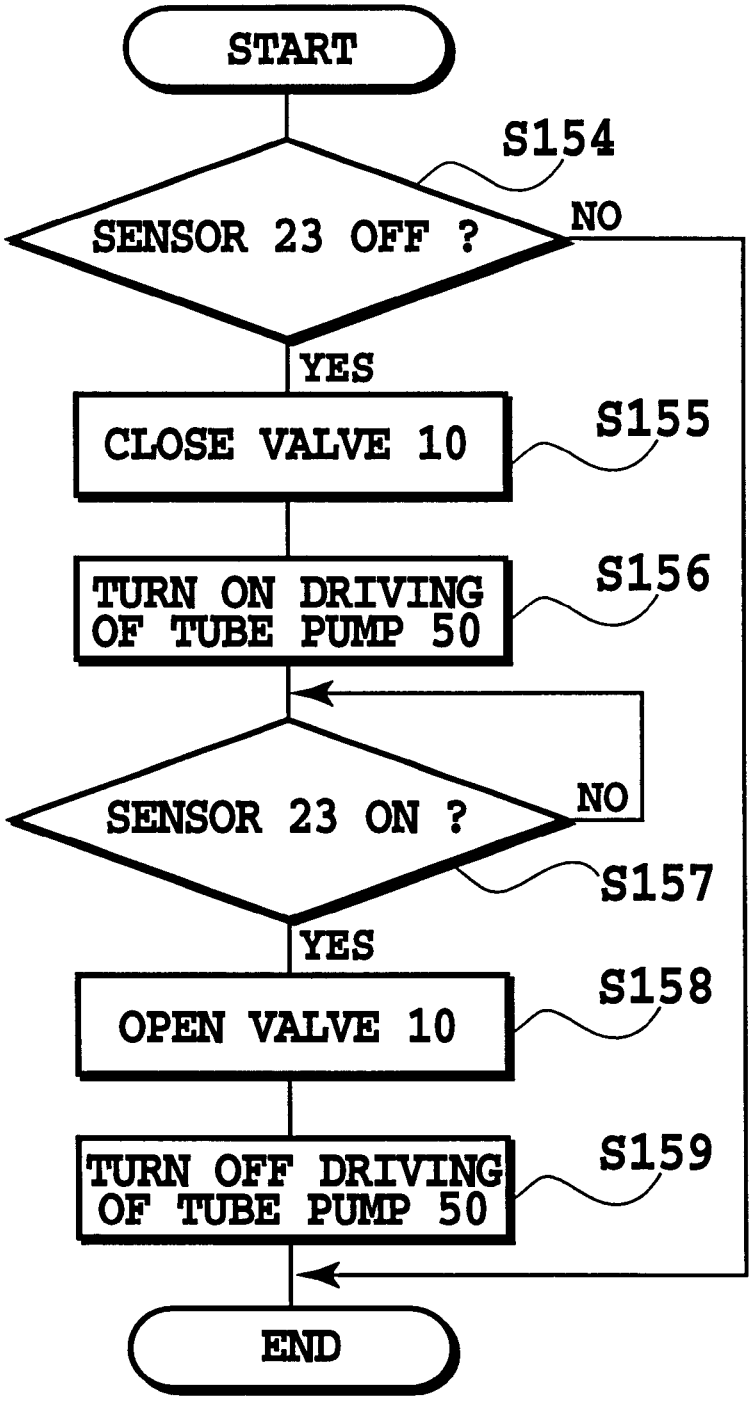
FIG. 7 is a flowchart for explaining a sequence relating to a liquid supply of the second embodiment of the liquid ejection printing apparatus according to the present invention.

Filling operation of the ink to the third ink tank 5 will be illustrated in FIG. 7. As set forth above, if the print stand-by signal is output (S129), presence or absence of the ink is detected by the ink level sensor 23 (S154). If the ink is present, process directly goes END. If absence of the ink is detected, valve 10 is closed (S155), and the tube pump 50 is driven (S156) for supplying and filling the ink to the third ink tank 5 until the ink level (liquid level) is detected by the ink level sensor 23 (S157). Once the ink is filled in the third ink tank 5, the valve 10 is opened (S158). Subsequently, driving of the tube pump 50 is stopped (S159). Through these operation, the third ink tank 5 can be maintained in the filled state as long as the ink being in the makeup pump 16. In the shown ink supply system, without taking the stand-by period for filling the ink in respective ink tank, printing can be performed smoothly without stopping printing.

If termination of printing is selected in judgement of termination of printing (S130) following print stand-by state (S129), ink supply terminating operation is performed. In the present invention, not shown supply control portion controlling the ink supply operation and not shown computer controlling ejecting operation of the printing head are driven simultaneously by a not shown drive control means. The drive control means may be formed with the not shown computer.

Figure 6C:
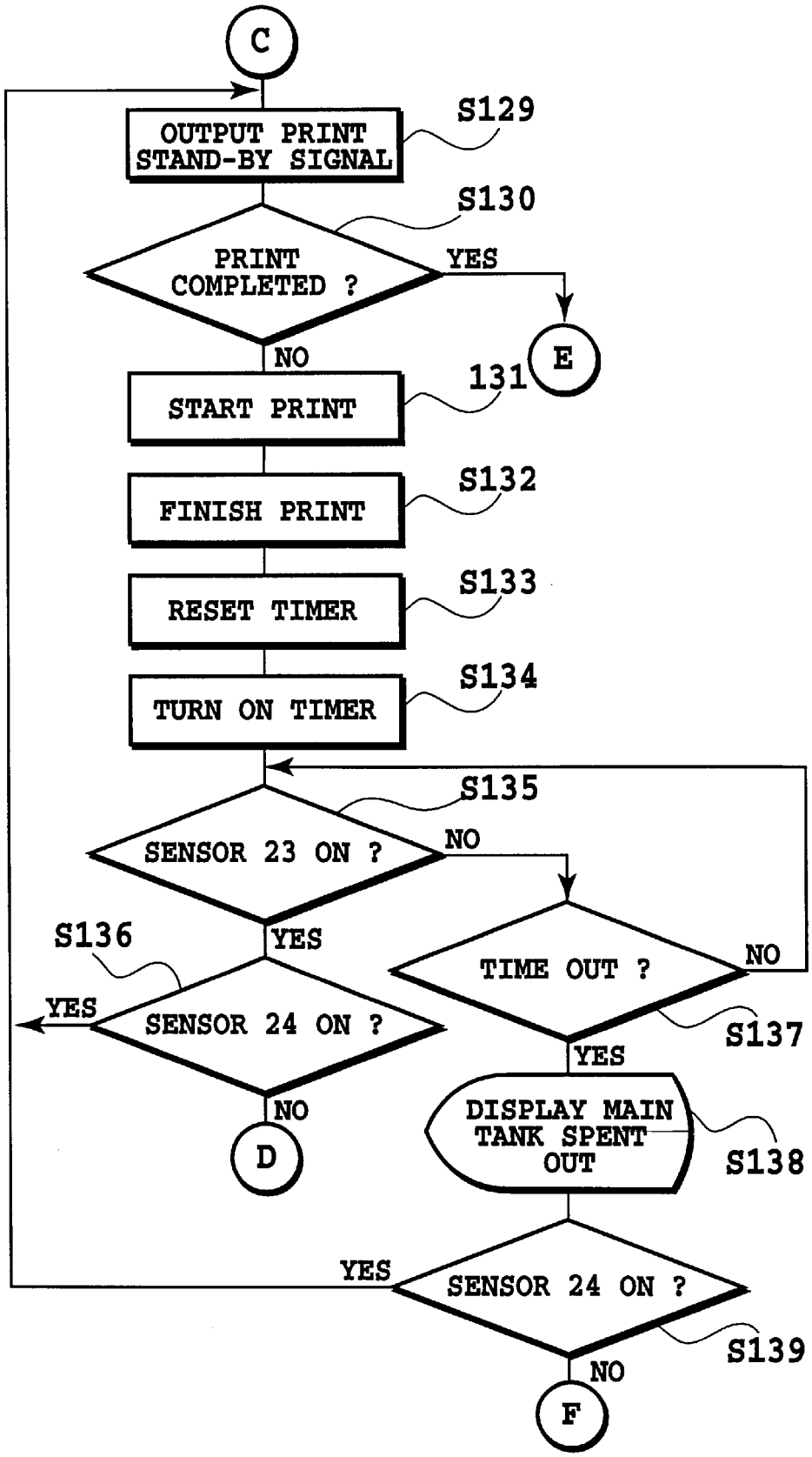
Figure 6D:
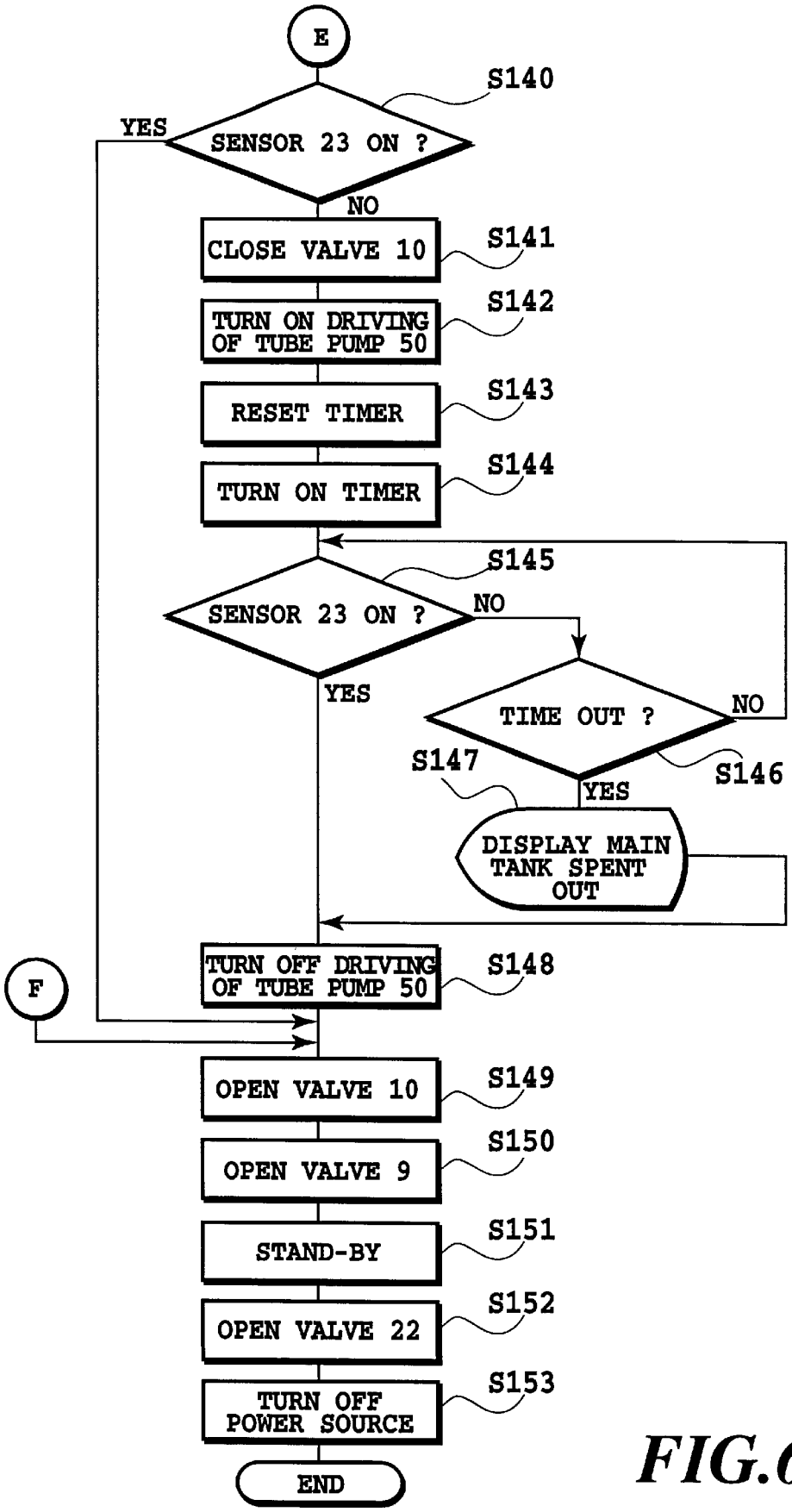

As shown in FIGS. 6C to 6D, if termination of printing is selected (S130), presence or absence of the ink is detected by the ink level sensor 23 of the third ink tank 5 (S140). If the ink is absent in the third ink tank 5, supplying and filling operation of the ink for the third ink tank 5 is performed.

At first, the valve 10 of the atmosphere communication opening is closed (S141) and the tube pump 50 is driven (S142). The timer for detecting presence or absence of the ink of the supply tank 16 is reset (S143) and then restart (S144). Judgement is made whether the ink is present or not in the third ink tank 5 by the ink level sensor 23 (S145). After detecting presence of ink, the process is advanced to the next step S148.

At step S145, judgement is made whether the ink is present or absent in the third ink tank 5 by the ink level sensor 23. If the ink is not filled in the third ink tank 5, and if the current timing is within a period sufficient for supplying and filling of the ink, the process is returned to step S145. If the ink is not detected by the ink level sensor even when the sufficient period for supplying and filling the ink is elapsed, time out is judged (S146). Since time out represents that the ink in the supply tank 16 is spent out. Therefore, "ink spent out" is displayed on a not shown display panel of the printing apparatus or on a computer connected to the printing apparatus (S147). Then, the process is advanced to step S148.

Subsequently, driving of the tube pump 50 is stopped (S148). Then, valves 10 and 9 are opened (S149 and S150) to transfer the ink to the second ink tank 4 to perform levelization. After stand-by state for a given period (S151), the valve 22 is opened (S152) and the power source of the apparatus is turned OFF (S153) to terminate operation of the apparatus.

By the terminating operation set forth above, the ink is filled for each tank. Therefore, when the printing apparatus is re-started for performing image printing for the next time, the ink is filled in each ink tank. Therefore, after turning ON of the power source for removing the bubble within the ink supply system, the ink level sensor 24 initiates operation from the step S113 in order to detect the ink in the second ink tank 4 and thus the penetration of the bubble into the ink nozzles can be prevented to enable stable output of the image.

Third Embodiment

Figure 9A:
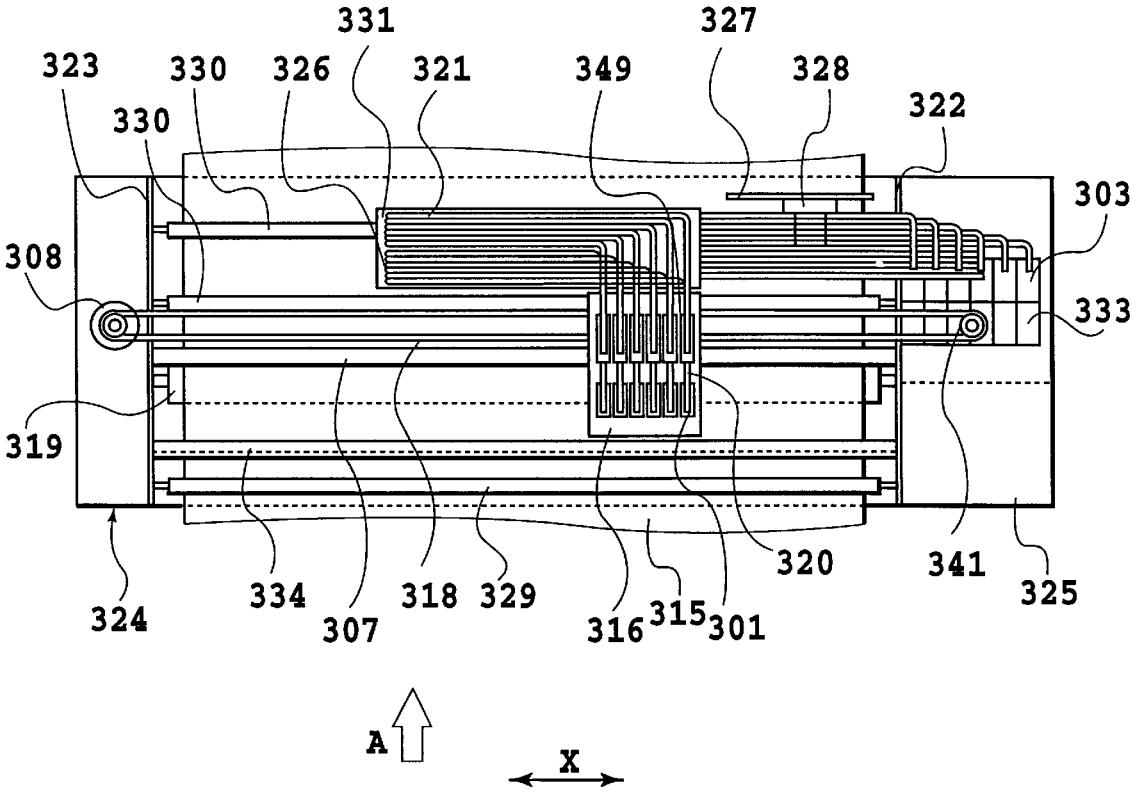
Figure 9B:
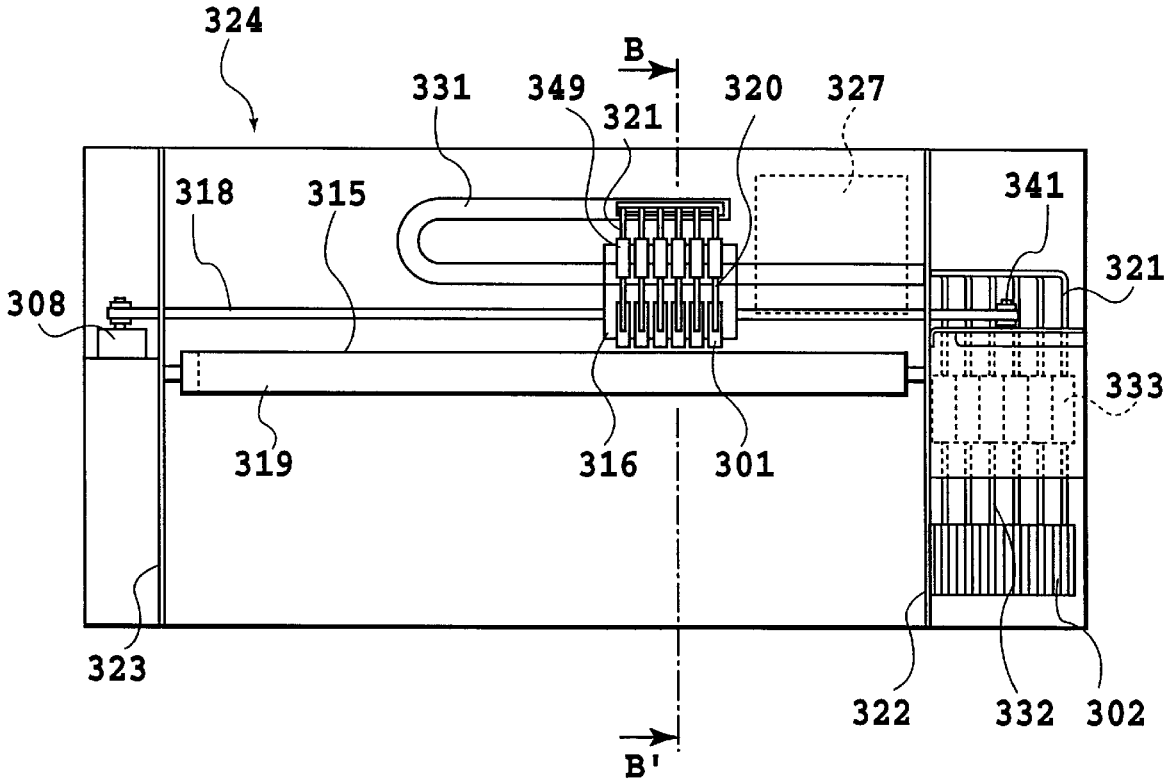

FIGS. 9A and 9B are explanatory illustrations of the ink-jet printing apparatus as one embodiment of the third embodiment of the liquid ejection printing apparatus according to the present invention, in which FIG. 9A is a top plan view and FIG. 9B is a front elevation of the ink-jet printing apparatus as viewed in the direction of arrow A as shown in FIG. 9A.

As shown in FIGS. 9A and 9B, the shown embodiment of the ink-jet printing apparatus, a casing 324 has a mutually opposing side plates 322 and 323. To the side plate 322, respective one ends of mutually parallel the primary scanning rail 307 and a carriage stay 334 are mounted. On the other hand, to the side plate 323, the other ends of the primary scanning rail 307 and the carriage stay 334 are mounted. By the primary scanning rail 307 and the carriage stay 334, a carriage 316 is supported for reciprocal movement in a direction of arrow X shown in FIG. 9A. On the carriage 316, six ejection head portions 301 for six colors of cyan, magenta, yellow, black, cyan light color, and magenta light color are mounted.

Each ejection head portion 301 has nozzle portion for ejecting the ink as the liquid toward the printing medium, such as a paper or a film. In each nozzle portion, electrothermal transducer for generating thermal energy for ejection of the ink is provided. Within the ejection head portion 301, the ink is supplied by capillary phenomenon in the nozzle portion. The ink forms meniscus at a tip end surface (hereinafter referred to as "nozzle surface") in which the nozzle portions of the ink ejection head 301 open and thus is maintained in a condition filling the nozzle portions. At this condition, by supplying electric power to the electrothermal transducer, bubbling is caused by heating the ink on the electrothermal transducer. By energy of bubbling, ink droplet is ejected through the nozzle.

On the other hand, to the ejection head portion 301, a driving substrate for driving the ejection head portion 301 is provided. The driving substrate of the ejection head portion 301 is connected to a main board 327 mounted on the casing 324 via a flexible cable 328. By feeding an electrical signal to the driving substrate of the ejection head portion 301 from the main board 327 through the flexible cable 328, ink ejection timing of the ejection head portion 301 can be controlled.

On the other hand, on one end of the casing 324, a primary scanning motor 308 is mounted. On the other end of the casing 324, a pulley 341 is mounted. Over the primary scanning motor 308 and the pulley 341, a belt 318 is stretched so that the belt 318 is driven by the main scanning motor 308 to travel. To one portion of the belt 318, the carriage 316 is connected. Accordingly, by driving of the belt 318, the carriage 316 is moved reciprocally in the direction of arrow X as shown in FIG. 9A.

On the carriage 316, six air buffers 349 as the first tanks respectively corresponding to six ejection head portions 301 are mounted. Each ejection head portion 301 is connected to the air buffer 349 corresponding to each ejection head portion by a head supply tube 320. On the end portion of the pulley 341 of the casing 324, a holding tank 333 as the second tank for temporarily storing the ink to be supplied to the ejection head portion 301 and a sub-tank 303 as the third tank temporarily storing the ink to be supplied to the holding ink 333 are mounted. On the lower side of the sub-tank 303 and the holding tank 333, a main tank 302 as the fourth tank for storing the ink to be supplied to the sub-tank 303 is mounted.

The holding tank 333, the sub-tank 303 and the main tank 302 are respectively divided into six chambers corresponding to respective color inks. Respective chambers of the holding tank 333 are connected to respectively corresponding air buffers 349 by holding tank tubes 326 as the first liquid supply passages. The air buffers 349 are connected to provided at positions in the vicinity of the ejection head portion 301. Respective chambers of the sub-tank 303 of the head are connected to corresponding air buffers 349 through sub-tank tubes 321 as the third liquid supply passages, respectively. On the other hand, respective chambers of the sub-tank 303 are connected to corresponding chambers of the main tank 302 via main tank tubes 332 as the fourth liquid supply passages.

Figure 11:
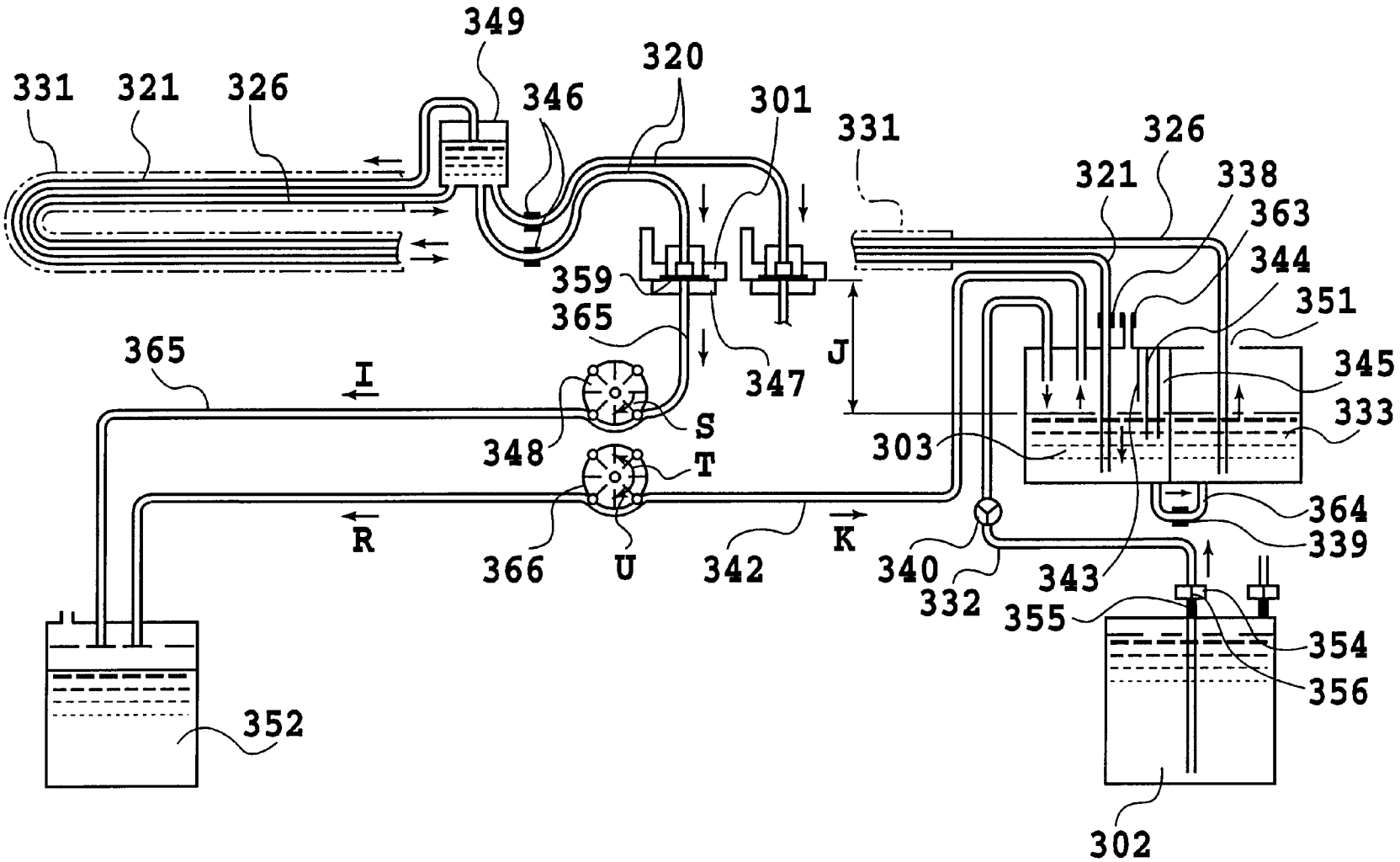
FIG. 11 is an illustration showing an ink passage of the third embodiment of the ink-jet printing apparatus according to the present invention.

In the vicinity of the sub-tank 303 and the main tank 302, a recovery system 325 constructed with a cap and so on which will be explained later with reference to FIG. 11, is provided. Detailed construction of the passage of the ink between the main tank 302 and the ejection head portion 301 and the liquid supply passage will be explained later.

As the flow of the ink in the shown embodiment of the ink-jet printing apparatus, the ink us supplied from the main tank 302 to the sub-tank 303 through the main tank tube 332. Thereafter, from the sub-tank 303, the ink is supplied to the holding tank 333 through the supply passage which will be explained later with reference to FIG. 11 and the sub-tank holding tank tube as the second liquid supply passage. Then, from the sub-tank 303, the ink is supplied to the air buffer 321 through the sub-tank tube 321 and from the holding tank 333, the ink is supplied to the air buffer 349 through the holding tank tube 326. From the air buffer 349 to the ejection head portion 301, the ink is supplied through the ink supply tube 320.

On the carriage 316, one end portion of flexible or articulated caterpillar 331 is fixed by means of fastening screws. The other end of the caterpillar 331 is fixed at position in the vicinity of the sub-tank 303 and the holding tank 333. The sub-tank tubes 321 and the holding tank tubes 326 extend through inside of the caterpillar 331.

On the other hand, on the casing 324, a paper feeding roller 330, an auxiliary scanning roller 319 and a paper ejection roller 329 extending in a direction parallel to motion direction of the carriage 316 are mounted. Respective one ends of the paper feeding roller 330, the auxiliary scanning roller 319 and the paper ejection roller 329 are rotatably supported on the side plate 322. The other ends of the paper feeding roller 330, the auxiliary scanning roller 319 and the paper ejection roller 329 are rotatably supported on the side plate 323. By the auxiliary scanning roller 319, the printing paper 315 as the printing medium is fed. On the other hand, by ejecting the ink from the ejection head portion 301 toward the printing paper 315, printing is performed on the printing paper 315. Next, explanation will be given for a transporting passage of the printing medium in the shown embodiment of the ink-jet printing apparatus with reference to FIGS. 10A and 10B.

Figure 10A:
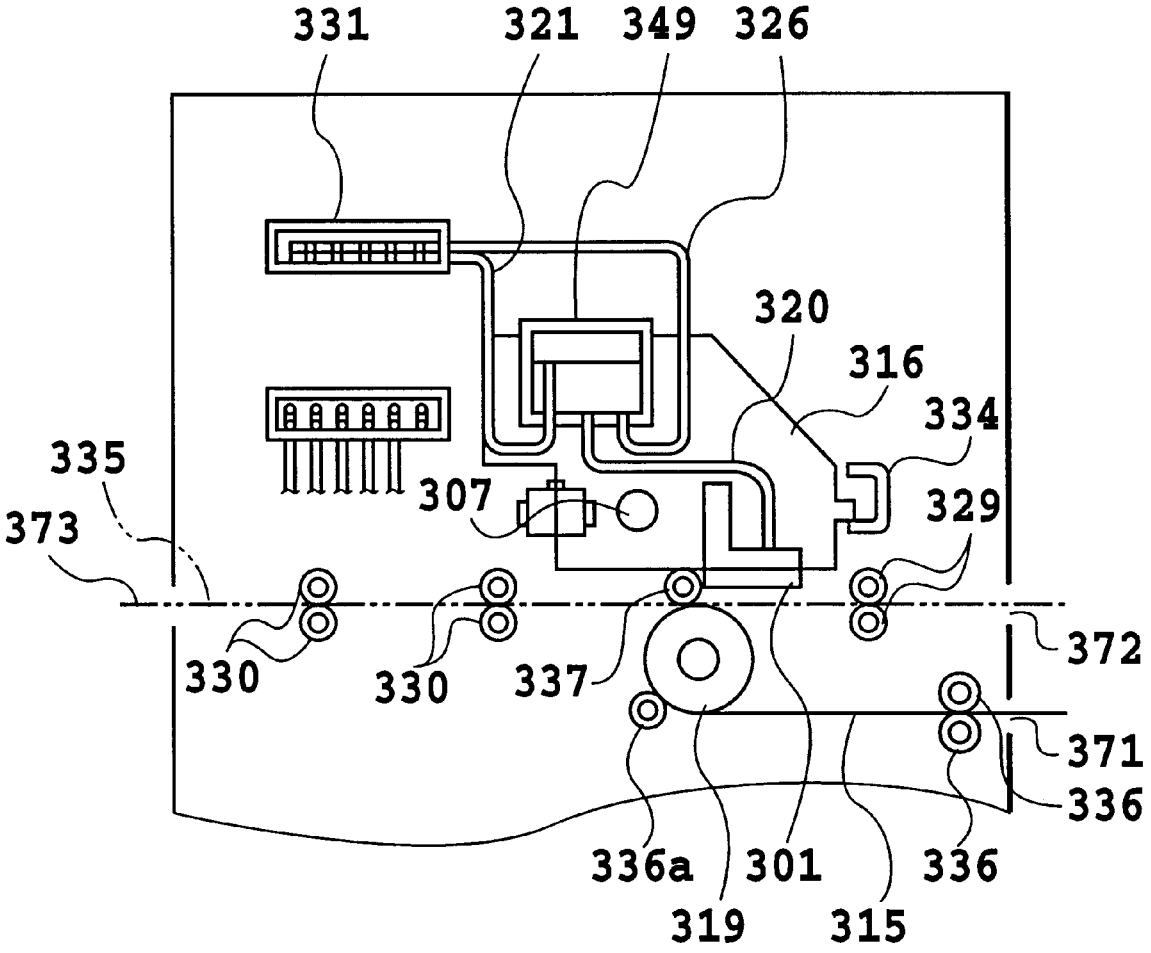

FIG. 10A is a section taken along line B–B' of FIG. 9B. When printing is performed for a easily flexible printing medium, such as a thin paper, film and the like, the printing paper 315 as the printing medium is inserted into a manual feeding opening 371 shown in FIG. 10A. The printing paper 315 thus inserted is gripped by opposing two manual feeding rollers 334 and is fed in a direction toward the auxiliary scanning roller 319. A manual driven roller 336*a* is biased toward the auxiliary scanning roller 319. The printing paper 315 reaching the auxiliary scanning roller 319 is gripped between the auxiliary scanning roller 319 and the manual driven roller 336*a* to be fed in the direction toward a driven roller 337 located in the vicinity of the ejection head portion 301. The driven roller 337 is biased toward the auxiliary scanning roller 319. The printing paper 315 reaching to the driven roller 337 is fed as being gripped between the auxiliary scanning roller 319 and the driven roller 337 to pass the lower side of the nozzle surface of the ejection head portion 301. Thereafter, the printing paper 315 is fed as being gripped by opposing two paper ejecting rollers 329 to be ejected outside of the ink-jet printing apparatus through a paper ejecting opening 372.

On the other hand, when a straight printing medium not possible to be bent or difficult to bent, such as a wooden plate, a thick paper, a thick film or the like, the straight printing medium 335 is inserted from an insertion opening 373. The straight printing medium 335 thus inserted is clamped between mutually opposing two paper feeding rollers 330 to be transferred in a direction toward the auxiliary scanning roller 319. When the straight printing medium 335 reaches the auxiliary scanning roller 319, the straight printing medium 335 is clamped between the driven roller 337 and the auxiliary scanning roller 319 and transported. Thus, the straight printing medium 335 passes through the lower side of the nozzle surface of the ejection head portion 301. Subsequently, the straight printing medium 335 is clamped between mutually opposing two paper ejection rollers 329 to be transported and thus to be ejected to the outside of the ink-jet printing apparatus form the paper ejecting opening 372.

The printing paper 315 or a straight printing medium 335 is located below the ejection head portion 301, by ejecting the ink from the ejection head portion 301, printing is performed for the printing paper 315 and the straight printing medium 335.

Figure 10B:
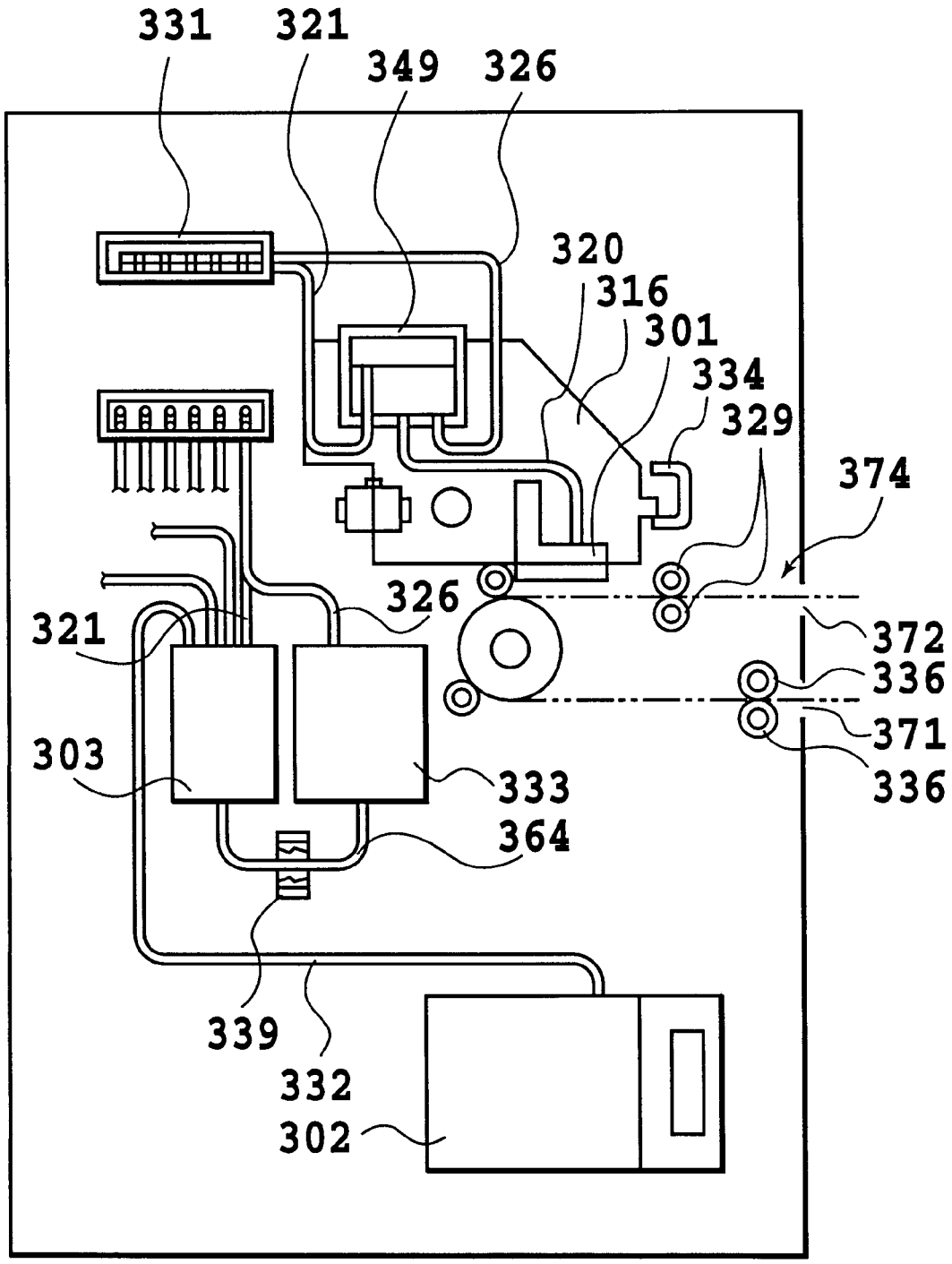

FIG. 10B is a section of the major portion of the ink-jet printing apparatus shown in FIGS. 9A and 9B. As shown in FIG. 10B, the sub-tank 303 and the holding tank 333 are located at lower position than the nozzle surface of the ejection head portion 301. Similarly to the conventional ink-jet printing apparatus, the sub-tank 303 and the holding tank 333 are arranged so that the meniscus is formed on the nozzle surface of the ejection head portion 301. Accordingly, the sub-tank 303 and the holding tank 333 are located at substantially the same height as the transporting passage 374. Here, as shown in FIGS. 9A and 9B, the sub-tank 303 and the holding tank 333 are mounted on the end portion of the casing 324. The sub-tank 303 and the holding tank 333 are arranged so as not to cause interference with the transporting passage 374 and the straight printing medium 335 shown in FIG. 10A.

Next, the construction of the ink passage and the liquid supply passage between the main tank 302 and the ejection head portion 301 in the shown embodiment of the ink-jet printing apparatus, will be explained with reference to FIG. 11.

FIG. 11 shows an ink passage of the shown embodiment of the ink-jet printing apparatus. The shown embodiment of the ink-jet printing apparatus uses a plurality of colors of inks. Therefore, the ink passage is provided for each color. The construction of each ink passage is the same with each other. Therefore, in FIG. 11, the construction of the passage is illustrated for only one color.

As shown in FIG. 11, the main tank 302 and the sub-tank 303 are connected through the main tank tube 332. In the intermediate position of the main tank tube 332, a check valve 340 as one-way valve is mounted. BY mounting the check valve 340, it becomes possible to flow the ink from the main tank 302 to the sub-tank 303. Conversely, flow of the ink from the sub-tank 303 to the main tank 302 is blocked. On the end of the main tank tube 332 on the side connected to the main tank 302, a joint 354 with a hollow needle 356 like an injection needle is mounted. The joint 354 is set in a rubber plug 355 provided in the main tank 302. The needle 356 pierces through the rubber plug 355 to connect the main tank tube 332 and the main tank 302. The other end of the main tank tube 332 is inserted into the sub-tank 303. In the sub-tank 303, a bar-like electrode A 343, electrode B 344 and electrode C 345 are inserted into the sub-tank 303 from the upper end of the sub-tank 303 in order to detect remaining amount of the ink within the sub-tank 303. With the electrode A 343, the electrode B 344 and the electrode C 345, a liquid surface detecting means detecting the liquid surface of the ink within the sub-tank 303 is formed. By the liquid surface detecting means, the liquid surface of the ink within the sub-tank 303 can be detected at a predetermined height to detect the remaining amount of the ink in the sub-tank 303.

Figure 12:
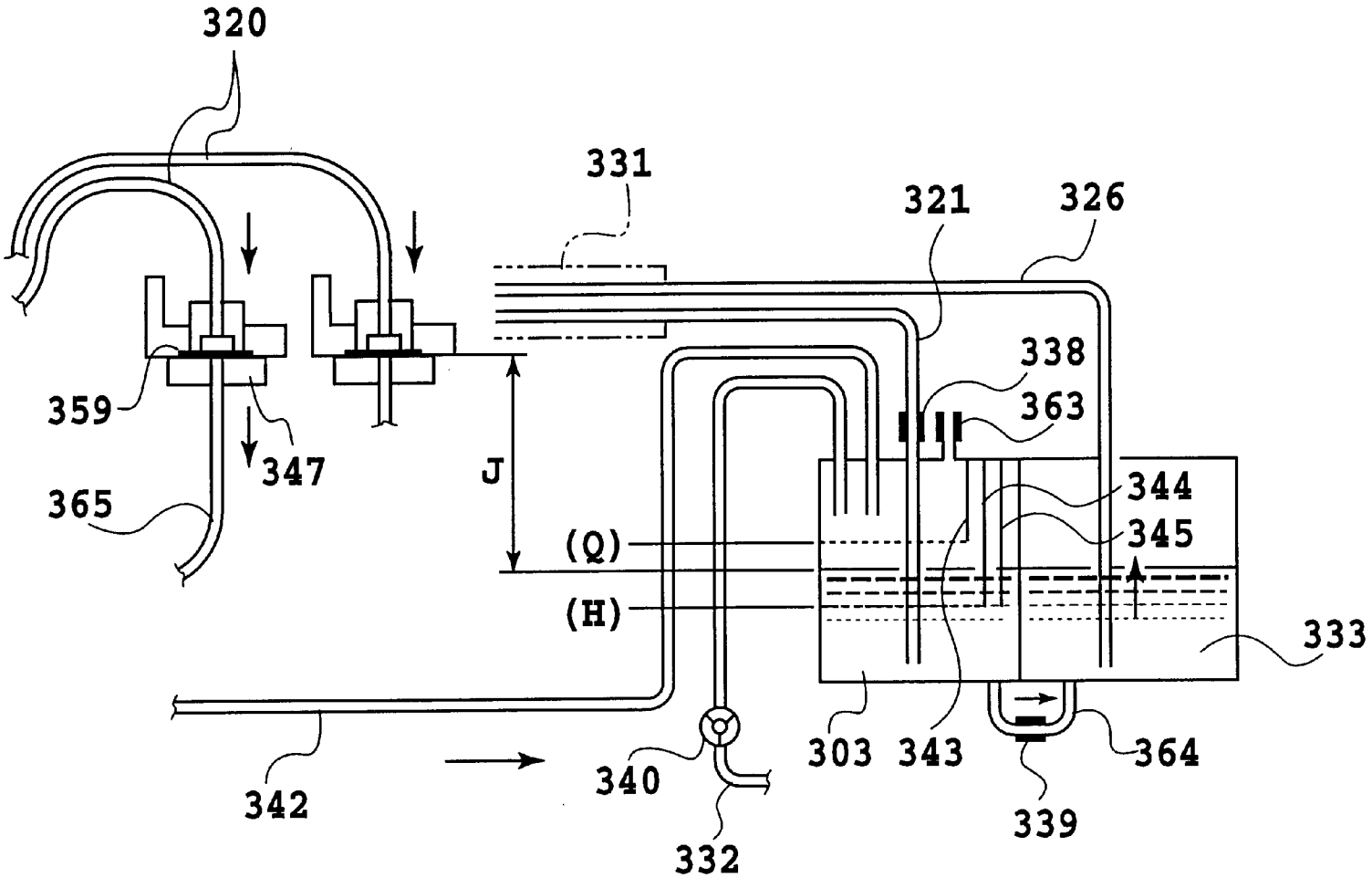
FIG. 12 is an enlarged illustration around a sub-tank of the ink passage shown in FIG. 11.

FIG. 12 is an enlarged view of the ink passage shown in FIG. 11 in the peripheral portion of the sub-tank 303. As shown in FIG. 11, the tip end of the electrode A 343 is inserted so that the tip end of the electrode A 343 is located at a height position indicated by (Q). The tip ends of the electrode B 344 and the electrode C 345 reach a height (H) located at deeper position than (Q). The electrode A 343, the electrode B 344 and the electrode C 345 are electrically connected to the main board 327 shown in FIGS. 9A and 9B, respectively. Low current flows through respective of the electrode A 343, the electrode B 344 and the electrode C 345 for detecting conduction between the electrodes through the ink as electrically conductive material for detecting the ink amount within the sub-tank 303. Particularly, if the liquid surface of the ink within the sub-tank 303 is lower than the height (H), the electrode B 344 and the electrode C 345 becomes non-conductive state. When non-conductive state between the electrode B 344 and the electrode C 345 is detected, the ink is supplied from the main tank 302 to the sub-tank 303 as will be explained later. If the liquid surface of the ink within the sub-tank 303 is higher than the height (Q), the electrode A 343 and the electrode B 344 are in conductive state to stop supply of the ink to the sub-tank 303.

On the other hand, at an upper portion of the sub-tank 303 higher than the height (Q), an atmosphere opening valve 363 to be opened and closed by a not shown driving source is provided.

The holding tank 333 is provided adjacent the sub-tank 303. The bottom surface of the holding tank 333 is located at the same height as the bottom surface of the sub-tank 303. On the bottom surface of the sub-tank 303, one end of the sub-tank holding tank tube 364 as the supply passage is connected. On the bottom surface of the holding tank 333, the other end of the sub-tank holding tank tube 364 is connected. Thus, by the sub-tank holding tank tube 364, the bottom portion of the sub-tank 303 and the bottom portion of the holding tank 333 are connected. At the intermediate position of the sub-tank holding tank tube 364, a sub-tank holding tank valve 339 is provided. The sub-tank holding tank valve 339 is adapted to block the ink passage between the sub-tank 303 and the holding tank 333 by crushing the sub-tank holding tank tube 364.

The sub-tank 303 and the air buffer 349 are connected through the sub-tank tube 321. One end of the sub-tank tube 321 is inserted into the sub-tank 303 from the upper end of the sub-tank 303. The one end of the sub-tank tube 321 is located at a position lower than the height of the lower ends of the electrode B 344 and the electrode C 345. The other end of the sub-tank tube 321 is inserted into the air buffer 349 from the upper end of the air buffer 349. The holding tank 333 and the bottom portion of the air buffer 349 are connected through the holding tank tube 326. The end of the holding tank tube 326 on the side of holding tank 333 is inserted into the holding tank 333 from the upper portion of the holding tank 333. The end surface of the holding tank tube 326 reaches in the vicinity of the bottom surface of the holding tank 333.

The bottom portion of the air buffer 349 and each ejection head portion 301 are connected by the head supply tubes 320. At the intermediate position of each head supply tube 320, a buffer valve 346 is provided.

A cap 347 for capping the ejection buffer portion 301 is connected to a waste ink tank 352 by a suction tube 365. In the suction tube 365, a suction pump 348 is provided. As the suction pump 348, a tube pump is employed. Under the condition where the ejection head portion 301 is capped with the cap 347, the suction pump 348 is driven to suck the ink within the ejection head portion 301 into the cap 347. The sucked ink is stored within the waste ink tank 352 through a suction tube 365.

Furthermore, the waste ink tank 352 and the sub-tank 303 are connected by a pump tube 342. One end of the pump tube 342 is inserted into the sub-tank 303 from the upper portion of the sub-tank 303. The one end of the pump tube 342 is located at the position higher than the lower end of the electrode A 343. To the pump tube 342, a supply pump 366 as a pressure generating means is provided for reducing and increasing pressure within the sub-tank 303. As the supply pump 366, the tube pump driven in forward and reverse directions may be employed.

The suction pump 348 and the supply pump 366 have rotors, respectively. Respective rotors of the pumps driven to rotate by a not shown pump motor for driving the pump. The rotor of the suction pump 348 is rotated in the direction shown by arrow S to drive the suction pump 348. The air and the ink within the suction tube 365 is moved in the direction shown by arrow I. The rotor of the supply pump 366 is driven to rotate in the direction shown by arrow T to drive the supply pump 366 in forward direction. Then, the air and ink within the pump tube 342 is moved in the direction shown by the arrow K. On the other hand, conversely to the above, the rotor of the supply pump 366 is driven to rotate in the direction of arrow U to drive the supply pump 366 in reverse direction to move the air and the ink within the pump tube 342 in the direction of arrow R.

On the other hand, the ink within the holding tank 333 flows into the sub-tank 303 through the holding tank tube 326, the air buffer 349 and the sub-tank tube 321. At this time, a flow resistance is smaller than the flow resistance upon flowing the ink in the main tank 302 through the main tank tube 332 and the check valve 340.

Liquid supply operation of the shown embodiment in the ink-jet printing apparatus constructed as set forth above will be explained with reference to FIGS. 13A to 13D. At first, the operation for supplying ink from the main tank 302 to the sub-tank 303 will be explained with reference to a flowchart of FIG. 13A.

At first, the atmosphere opening valve 363, the sub-tank 338 and the sub-tank holding tank valve 339 are closed (S201, S202 and S203) to enclose the sub-tank 303. The rotor of the supply pump 366 is driven to rotate in a direction of arrow U for forward driving (S204). By this, the air in the pump tube 342 is moved in the direction of arrow R to discharge air in the sub-tank 303 through the pump tube 342. Thus, the pressure in the sub-tank 303 is reduced to be a negative pressure. By situating the sub-tank 303 in the negative pressure condition, the ink within the main tank 302 is supplied into the sub-tank 303 through the main tank tube 332.

When both of the electrode A 343 and the electrode B 344 the foregoing ink supply operation from the main tank 2 to the sub-tank 303, electric current flows between the electrode A 343 and the electrode B 344 to detect that the ink is filled in the sub-tank 303 (S205). Then, a signal is fed to the main board 327.

When the signal is fed from the electrode A 343 and the electrode B 344 to the main board 327, a stop command is issued from the main board 327 to the supply pump 366 to stop the supply pump 366 (S206).

Next, the atmosphere opening valve 363, the sub-tank 338 and the sub-tank holding tank valve 339 are opened (S207, S208 and S209). Then, the ink in the sub-tank 303 enters into the holding tank 333 through the sub-tank holding tank tube 364 by own weight of the ink. At this time, until the height of the liquid surface of the sub-tank 303 becomes the same height as the liquid surface of the ink within the holding tank 333, the ink within the sub-tank 303 flows into the holding tank 333.

It should be noted that when the ink and air (bubble) are present within the sub-tank holding tank 364, the ink becomes difficult to flow through the sub-tank holding tank tube 364 or impossible to flow through the sub-tank holding tank tube 364. In this case, operation to forcedly supply the ink within the sub-tank 303 into the holding tank 333 through the sub-tank holding tank tube 364. The operation for forcedly supplying ink from the sub-tank 303 to the holding tank 333 will be explained with reference to the flowchart in FIG. 13B.

At first, after closing the atmosphere opening valve 363 and the sub-tank 338 (S210 and S2111), the rotor of the supply pump 366 is rotated in the direction of arrow T to drive the supply pump 366 in reverse direction (S212 and S213) to feed the air within the pump tube 342 in the direction of arrow K. By this, the air in the pump tube 342 is fed into the sub-tank 303 to pressurize inside of the sub-tank to positive pressure. When the inside of the sub-tank becomes positive pressure, the ink within the sub-tank 303 is pushed into the sub-tank holding tank tube 364. Then, the air (bubble) presenting within the sub-tank holding tank tube 364 is pushed into the holding tank 333 together with the ink. Subsequently, the supply pump 366 is stopped (S214), and the atmosphere opening valve 363 and the sub-tank valve 338 are opened (S215 and S216). As a result, the sub-tank holding tank tube 364 is filled with the ink and thus the ink in the sub-tank 303 flows into the holding tank 333 through the sub-tank holding tank tube 364 until the height of the ink within the sub-tank 303 and the height of the ink within the holding tank 333 become equal to each other. Here, since the holding tank 333 is opened to the atmosphere through the atmosphere opening hole 351, when the air (bubble) is pushed into the holding tank 333 from the sub-tank holding tank tube 364, the air within the holding tank 333 is discharged into the atmosphere through the atmosphere opening hole 351. Thus, the pressure within the holding tank 333 can be maintained at the atmospheric pressure.

After the height of the ink within the sub-tank 303 and the height of the ink within the holding tank 333 become equal to each other by flowing the ink from the sub-tank 303 into the holding tank 333, the liquid level of the ink in the sub-tank 303 can be lower than the lower ends of the electrode B 344 and the electrode C 345. In this case, since the ink is not present between the electrode B 344 and the electrode C 345, shut-off of the current between the electrode B 344 and the electrode C 345 is detected as illustrated in the flowchart shown in FIG. 10C (S217). When shutting off of the current between the electrode B 345 and the electrode C 345 is detected, a command signal for initiation of the ink supply operation is transmitted from the main board 327 shown in FIG. 9, again. Thus, the ink supply operation from the main tank 302 to the sub-tank 303 is performed in the similar manner as that illustration in the flowchart of FIG. 10A.

By repeating the ink supply operation from the main tank 302 and the sub-tank 303 set forth above, height of the liquid surfaces of the ink within the sub-tank 303 and the holding tank 333 is maintained within a range of lines (Q) and (H) shown in FIG. 12.

Figure 13A:
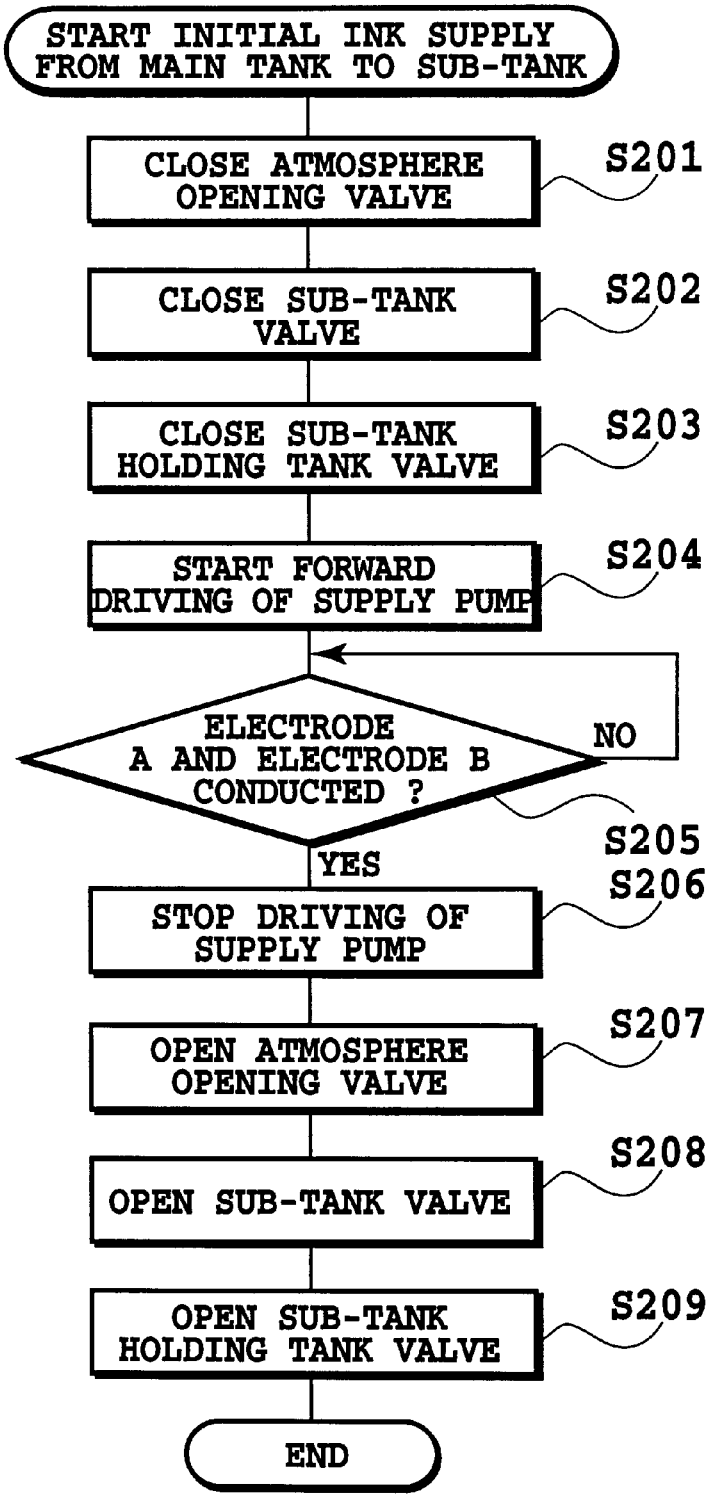
FIGS. 13A to 13D are flowcharts for explaining sequences relating to liquid supply in the third embodiment of the liquid ejection printing apparatus according to present invention.
Figure 13B:
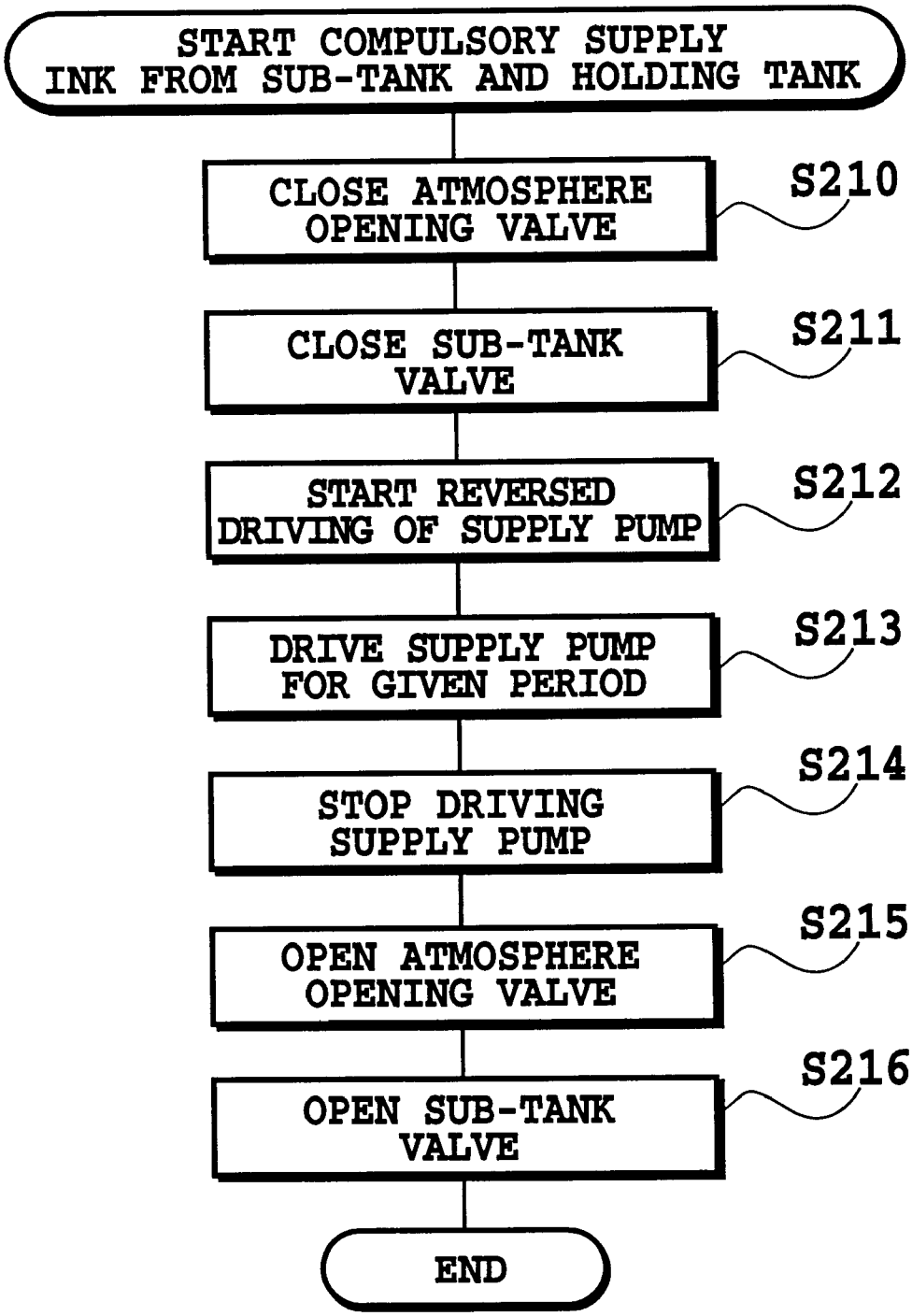
Figure 13C:
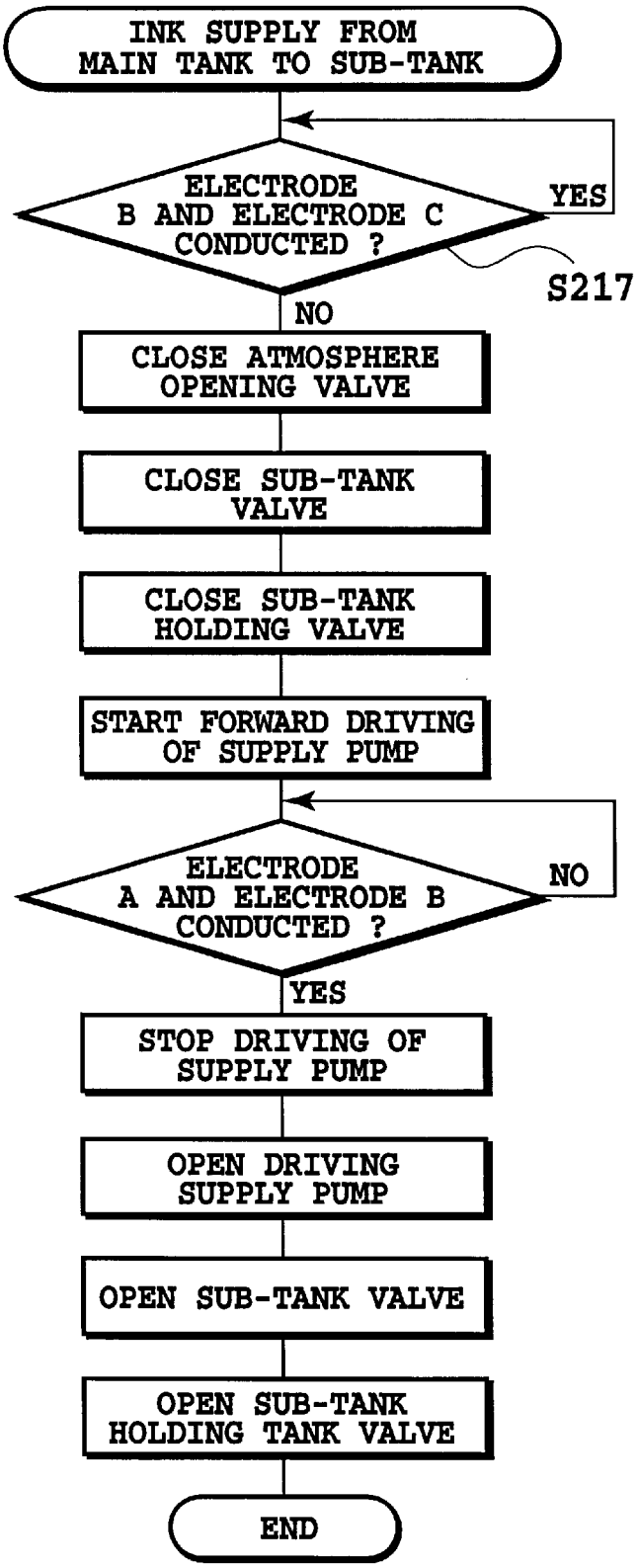
Figure 13D:
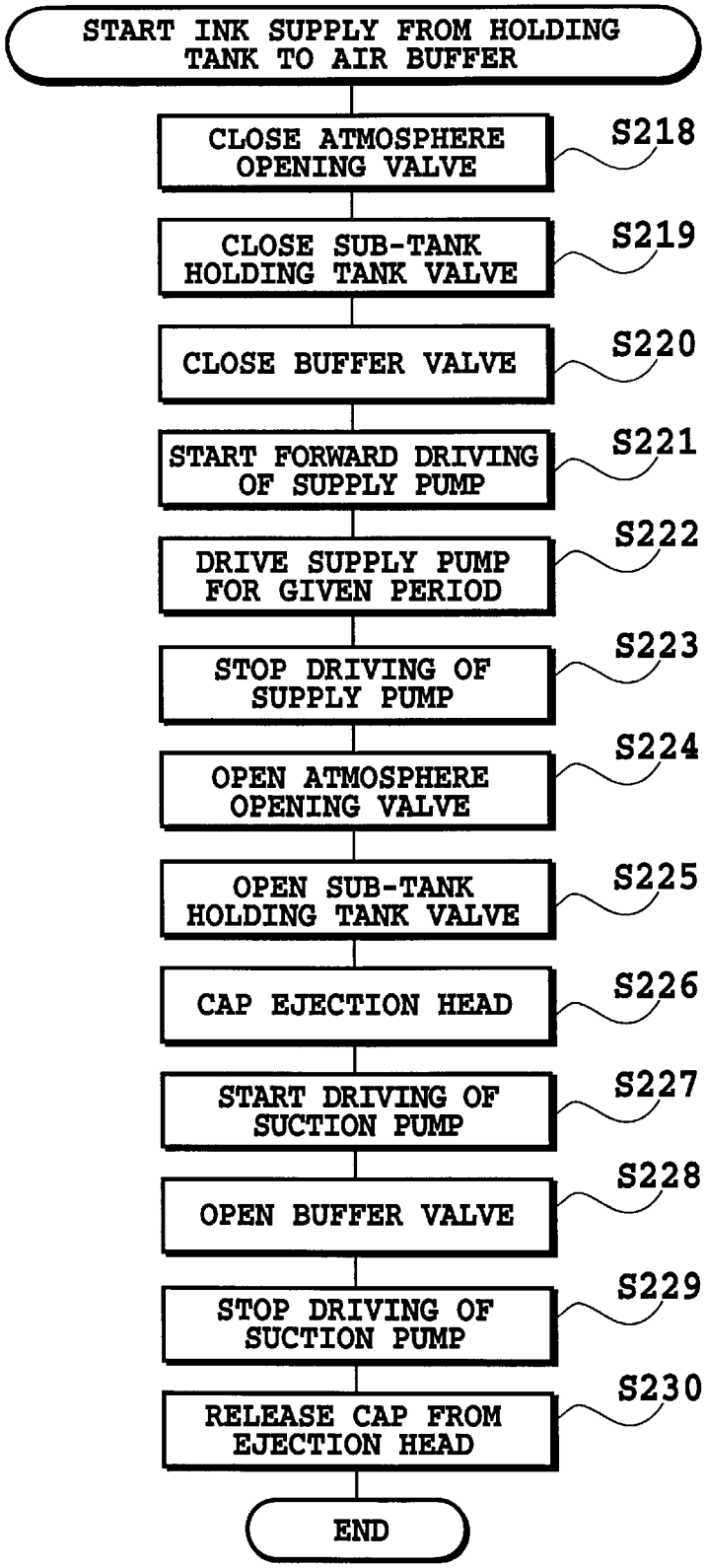

Next, the ink supply operation from the holding tank 333 to the air buffer 349 will be explained with reference to the flowchart of FIG. 13D.

At first, the atmosphere opening valve 363, the sub-tank holding tank valve 339 and the buffer valve 346 are closed (S218, S219 and S220). Then, the rotor of the supply pump 366 is driven to rotate in the direction of allow U for driving the supply pump 366 in the forward direction (S221). The supply pump 366 is driven for a given period (S222) for feeding the air within the pump tube 342 in the direction of arrow R to discharge the air of the sub-tank 303 through the pump tube 342. Thus, the pressure in the sub-tank 303 is lowered to be negative pressure. As a result, the air buffer 349 and the holding tank tube 326 become negative pressure.

As set forth above, by making the insides of the sub-tank 303, the sub-tank tube 321, the air buffer 349 and the holding tank tube 326 negative pressure, the ink in the holding tank 333 is supplied into the air buffer 349 through the holding tank tube 326. Until the ink within the air buffer 349 contacts with the sub-tank tube 321, the liquid surface of the ink within the air buffer 349 is elevated. Then, the ink within the air buffer 349 is fed into the sub-tank 303 through the sub-tank tube 321.

On the other hand, at this time, since the interior of the main tank tube 332 also becomes negative pressure, the ink is also supplied from the main tank 302 to the sub-tank 303. After a given period from initiation of driving of the supply pump 366, the supply pump 366 is stopped (S223).

Thereafter, the atmosphere opening valve 363 and the sub-tank holding tank valve 339 are opened (S224 and S225). Here, as set forth above, the ink passage is constructed so that the resistance of the flow passage to flow the ink through the holding tank tube 326, the air buffer 349 and the sub-tank tube 321 becomes smaller than the resistance of the flow passage when the ink flows through the main tank tube 332 and the check valve 340. This enables to certainly supply the ink from the holding tank 333 to the air buffer 349.

Next, the ink supply operation from the air buffer 349 to the ejection head 301 will be explained with reference to FIGS. 13D.

At first, the ejection head portion 301 is capped by the cap 347 (S226). Then, the suction pump 348 is driven (S227) to move the air in the suction tube 365 in the direction of arrow I. By this, the insides of the cap 347 and the ejection head portion 301 become negative pressure. Then, the buffer valve 346 is opened (S228). Since the insides of the cap 347 and the ejection head portion 301 are held in negative pressure, the ink within the air buffer 349 is supplied to the ejection head portion 301 through the head supply tube 320. Thus, the ink is filled in the nozzles of the ejection head portion 301. Thereafter, the suction pump 348 is stopped (S229). After waiting the negative pressure in the cap 347 and the negative pressure of the air buffer 349 to be elevated (varied toward the positive pressure) to the predetermined value, the cap 347 is released from the ejection head portion 301 (S230). At this time, to the ink within the nozzle surface of the ejection head portion 301, the meniscus is formed. Therefore, even when a height difference J is present between the nozzle surface 359 of the ejection head portion 301 and the liquid surfaces of the ink within the sub-tank 303 and the holding tank 333 is present, the ink can be held within the nozzles of the ejection head portion 301. Here, the ink sucked into the cap 347 is collected into the waste ink tank 352 through the suction tube 365.

As set forth above, by supplying the ink to the nozzles in the ejection head portion 301, the ink can be ejected from the ejection head portion 301.

Next, the ink supply operation for supplying ink from the main tank 302 to the sub-tank 303 while printing is performed by ejecting the ink from the ejection head portion 301 toward the printing medium.

In the shown embodiment of the liquid supply apparatus, it is possible to supply the ink in the holding tank 333 to the air buffer 349 through the holding tank tube 326 while ink is supplied from the main tank 302 to the sub-tank 303. On the other hand, at this time, since the buffer valve 346 is opened, ink can be supplied from the air buffer 349 to the ejection head portion 301 through the head supply tube 320. Therefore, similarly to the foregoing second embodiment, printing by the ejection head portion 301 onto the printing medium can be performed even while the ink is supplied from the main tank 302 to the sub-tank 303.

On the other hand, when the ink is not supplied from the main tank 302 to the sub-tank 303, the main tank 302 can be exchanged even while printing is performed onto the printing medium by the ejection head portion 301. Accordingly, when the ink in the main tank 302 is spent out while printing is performed by ejecting the ink from the ejection head portion 301, the main tank 302 is exchanged while the ink is not supplied from the main tank 302 to the sub-tank 303 for setting the main tank 302 filled with the ink to the main body of the ink-jet printing apparatus without interrupting printing by the printing head portion 301.

As will be explained, in the shown embodiment, in order to stably supply the ink to the sub-tank 303, the pressure in the inside of the sub-tank 303 is lowered. Upon supplying the ink to the sub-tank 303, the inside of the sub-tank is enclosed. Therefore, even when the ink is not supplied from the sub-tank 303 to the holding tank 333, the in temporarily held in the holding tank 333 is supplied to the ejection head portion 301. Accordingly, even if the sub-tank 303 is enclosed and thus, the liquid is supplied to the sub-tank 303, printing by the ejection head portion 301 is not interrupted to permit large amount printing continuously at short period. Particularly, in case of the shown embodiment, in addition, since mechanism for performing opening and closing of the valve and a mechanism for detecting a remaining amount are also incorporated within the casing, in addition, concerning supply operation other than circulating operation, it becomes unnecessary to perform the operation at s special position, such as a home position or the like. Therefore, the foregoing effect can be achieved more effectively.

On the other hand, by setting the flow path resistance when the liquid in the holding tank flows through a first liquid supply passage, the air buffer and the third liquid supply passage into the sub-tank, to be smaller than flow resistance of the fourth supply passage, the pressure in the sub-tank is lowered to supply the ink from the holding tank to the air buffer. Then, the liquid amount supplied from the main tank to the sub-tank is limited. Accordingly, the liquid can be certainly supplied to the air buffer connected to the ejection head portion.

Furthermore, by mounting the sub-tank 303 and the holding tank 303 on the casing 324, the sub-tank 303 and the holding tank 333 are arranged on the portion excluding a path for transporting the straight printing product 335 difficult to be bent can be in the horizontal direction. As a result, as disclosed in Japanese Patent Application Laid-open No. 6521/1998, even for the straight printing product 335 which is difficult to print by the in-jet printing apparatus, printing can be performed without bending the printing product 335.

Furthermore, by incorporating a positive pressure generating means for pressurizing the sub-tank in order to feed the liquid of the sub-tank into the holding tank through the supply passage, a gas stays within the supply passage to cause difficulty of flow of the supply passage or not to flow. By pressurizing in the sub-tank by means of the positive pressure generating means, the gas within the supply passage is forcedly flow into the holding tank together with the liquid in the sub-tank. Accordingly, even when the gas is accumulated within the supply passage, the liquid can smoothly flow through the supply passage.

Fourth Embodiment

Figure 14:
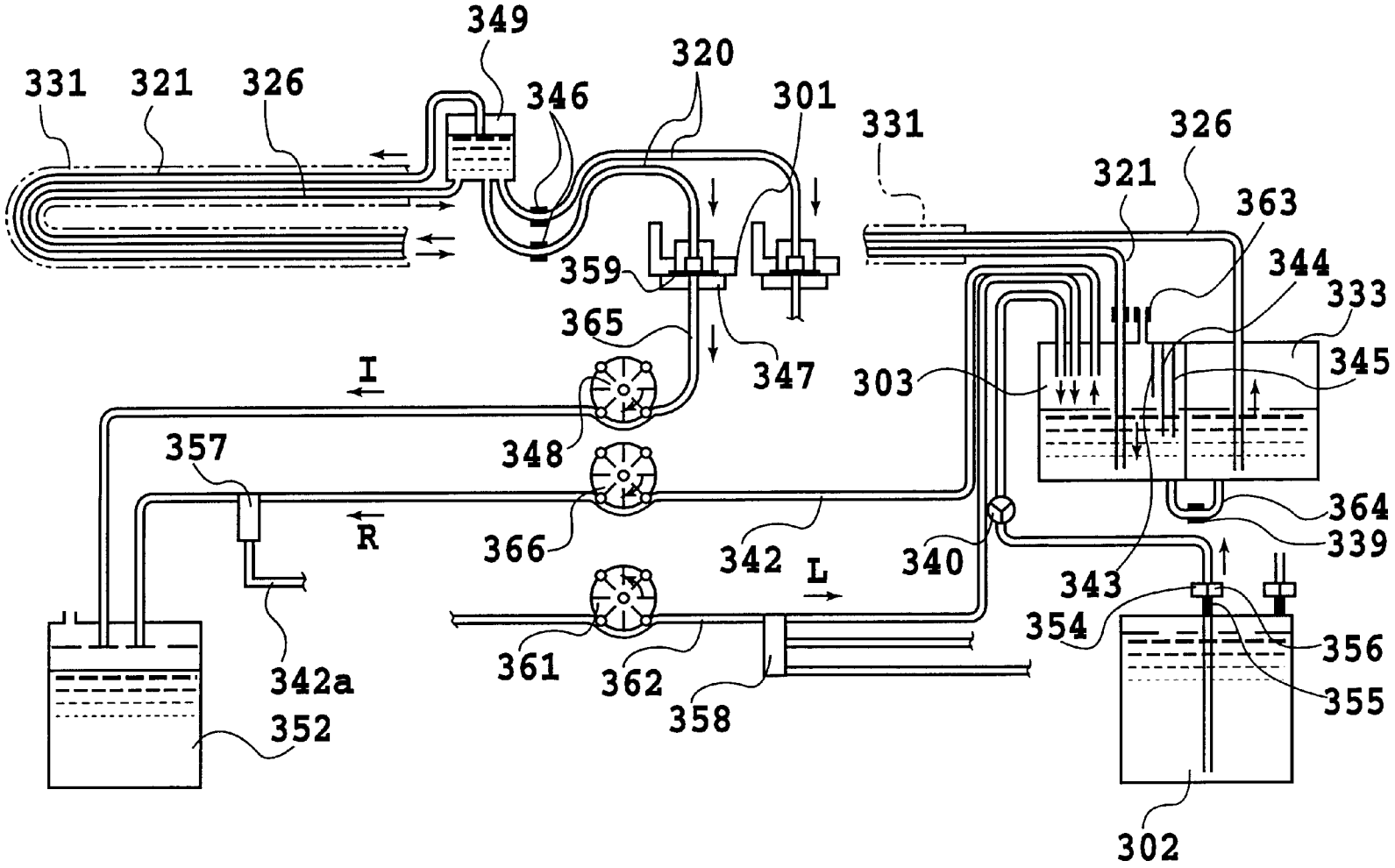
FIG. 14 is an explanatory illustration of the fourth embodiment of the ink-jet printing apparatus according to the present invention.

FIG. 14 is an illustration showing an ink passage of the fourth embodiment of the ink-jet printing apparatus according to the present invention. In the shown embodiment of the ink-jet printing apparatus, in comparison with the third embodiment, a positive pressure pump as the positive pressure generating means for pressurizing the sub-tank is provided. In FIG. 14, like components to those of the third embodiment will be identified by like reference numerals. Hereinafter, the following explanation will be given mainly for different points of the third embodiment.

In the shown embodiment of the ink-jet printing apparatus, as shown in FIG. 14, one end of the positive tube 362 is inserted into the sub-tank 303 from the upper portion of the sub-tank 303. At the intermediate portion of the positive tube 362, the positive pressure pump 361 as the positive pressure generating means for pressurizing the inside of the sub-tank 303 to positive pressure, is provided. By driving the positive pressure pump 361, air in the positive pressure tube 362 is moved in the direction of arrow L to feed the air into the sub-tank 303 through the positive tube 362.

At the position between the positive pump 361 and the sub-tank 303 in the positive tube 362, a switching valve 358 is provided. The switching valve 358 is connected to respective chambers of the sub-tank 303 via the tubes. By mounting the switching valve 358, respective chambers of the sub-tank 303 can be pressurized by one positive pressure pump 361 to positive pressure.

On the other hand, by providing the positive pressure pump 361, the supply pump 366 which serves as negative pressure generating means only for making the interior pressure of the sub-tank 303 negative pressure, is employed. Accordingly, without switching the rotating direction of the rotor of the supply pump 366 between forward direction and reverse direction, the ink in the sub-tank 303 is fed into the holding tank 333. The positive pressure pump 361 is only required to feed the air, a material of the components of the positive pressure pump 361 can be selected without considering property upon contacting with the ink. Thus, inexpensive one can be used as the positive pressure pump 361.

Furthermore, at a portion of the pump tube 342 between the supply pump 366 and the waste ink tank 352, one end of the tube 342*a* via a joint 357 is connected. A portion of the pump tube 342 on the opposite side of the sub-tank 303 is disconnected from the waste ink tank 352 as required to discharge air in the sub-tank 303 at the other end of the tube 342*a*. By this, number of tubes to be connected to the waste ink tank 352 can be reduced to improve assembling ability of the ink-jet printing apparatus. In conjunction therewith, it becomes possible to effectively use the internal space of the ink-jet printing apparatus and also to make the ink-jet printing apparatus compact.

While the foregoing description has been given for major part of the embodiment of the present invention, supplementary explanation will be given with respect to modifications of the respective embodiments.

Figure 15:
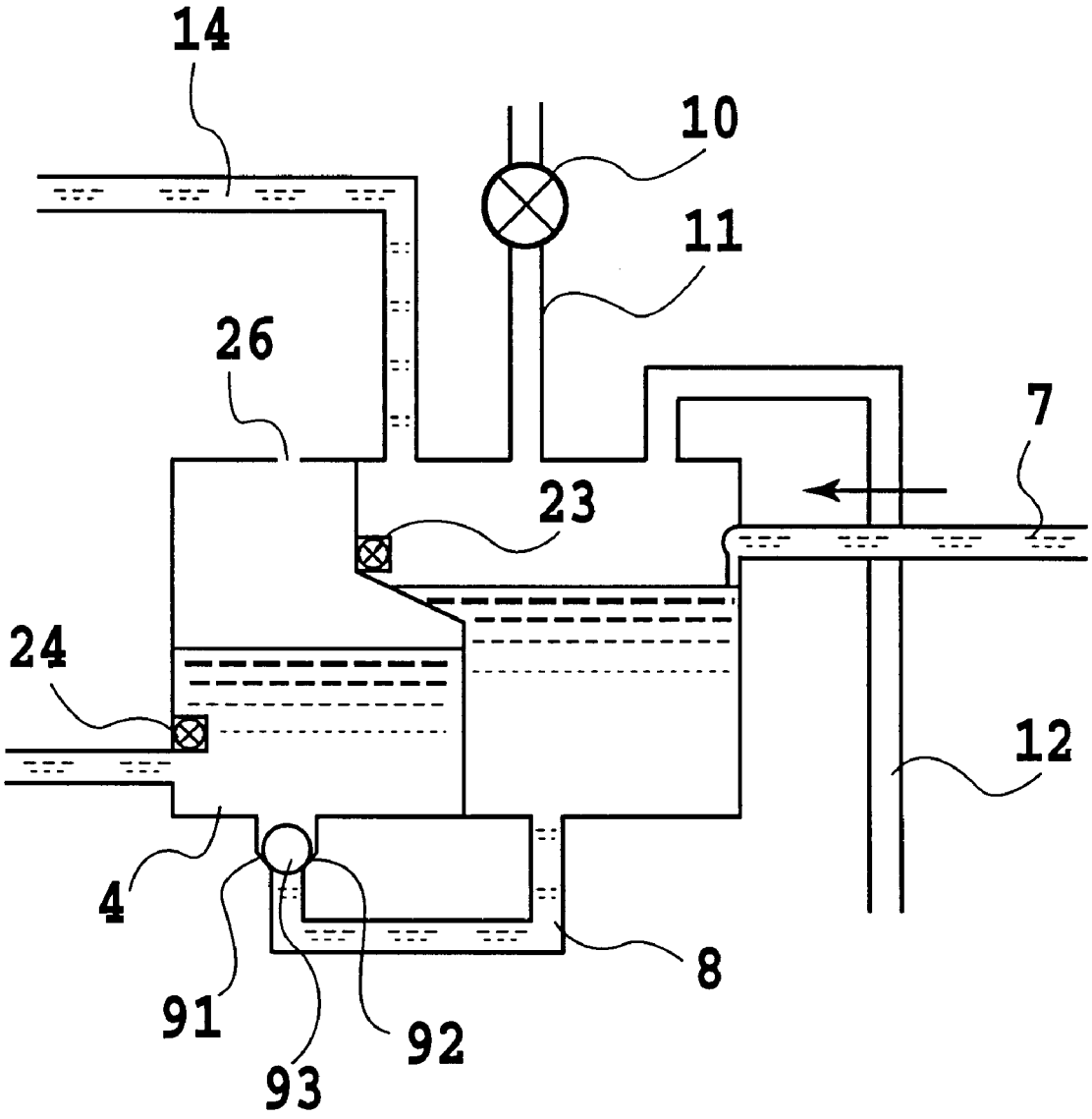
FIG. 15 is an explanatory illustration showing a major portion of a modification of the first embodiment of the present invention.

FIG. 15 is an explanatory illustration showing the major part of a modification of the first embodiment of the present invention. In the foregoing embodiment, a first valve is constructed with a general switching valve. However, it is also possible to employ so-called check valve permitting flow of the ink from the third ink tank 5 to the second ink tank 4.

The shown modification is basically constructed by providing the check valve 91 in place of the first valve 9 of the first embodiment. The check valve 91 is provided at a joint portion of the second ink passage 8 to the second ink tank 4, and is constructed with a cone-shaped taper portion 92 and a ball 93. The ball 93 is preferred to be as light as possible while its specific weight is greater than the ink. For instance, a plastic ball of polyacetal, polypropylene and so forth is employed. The taper portion is preferred to be slightly flexible as a hard rubber so as to always tightly close the check valve.

When a command for levelization is input from the control system control portion, the second valve 10 is opened. Then, the air chamber of the ink tank 5 is communicated with the atmosphere. Then, by the pressure corresponding to a water-head difference of the ink within the ink tank 4 and the ink tank 5, the ball 93 is pushed upwardly to open the check valve 91. Then, the ink flows from the ink tank 5 to the ink tank 4 through the flow passage 8. When the ink levels of the ink tanks 4 and 5 become substantially equal to each other, the ball 91 again contacts with the taper portion 92 to stop flow of the ink.

By providing the check valve 91 in place of the first valve 9, the foregoing mechanism and sequence can be simplified.

Figure 16:
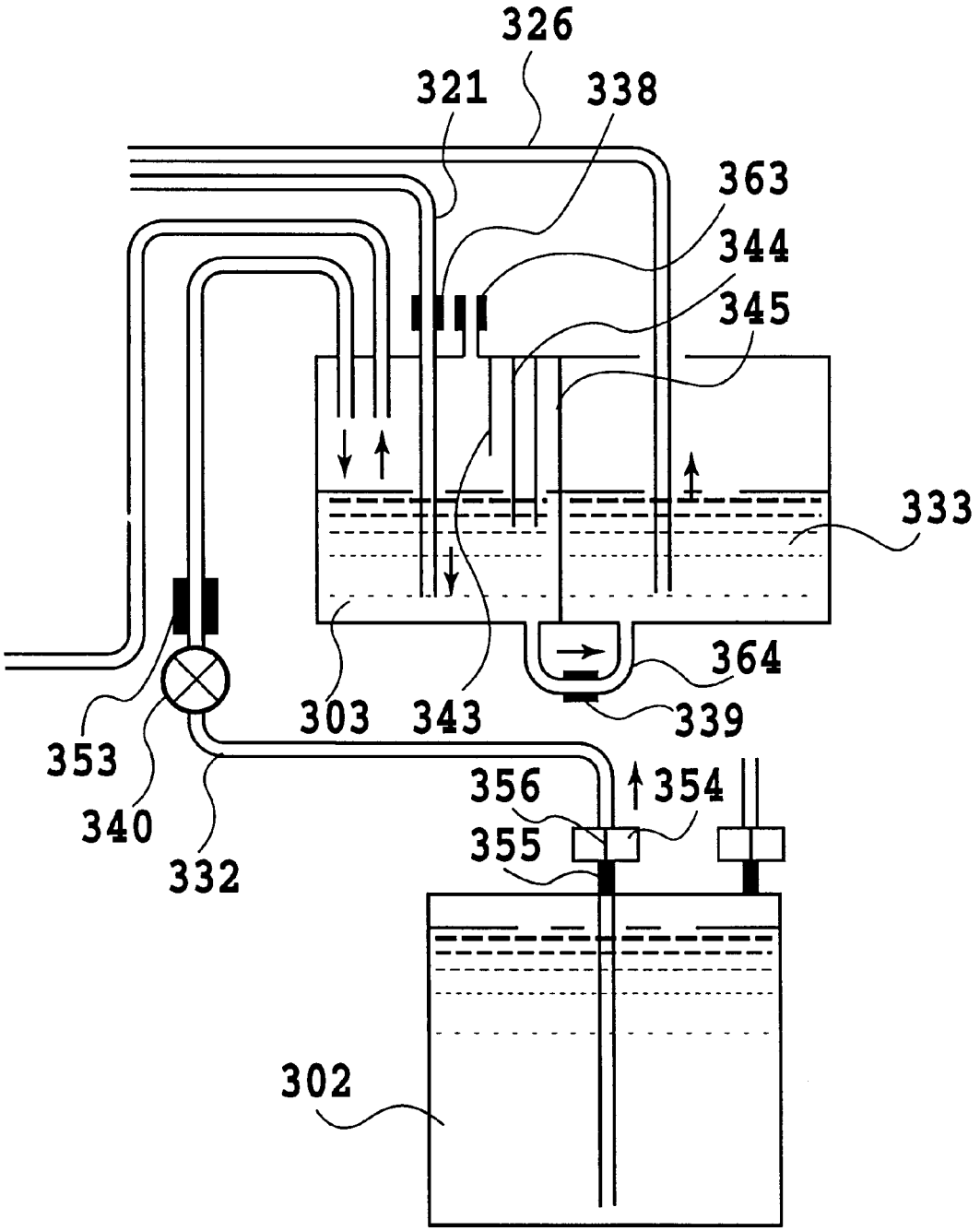
FIG. 16 is an explanatory illustration showing a major portion of a modification of the third embodiment of the present invention.

FIG. 16 is an explanatory illustration showing the major part of a modification of the third embodiment set forth above. Different from the former embodiment, in the shown modification, a flow resistance member 353 making flow resistance for the ink flowing in the main tank tube 332 is provided at the intermediate position of the main tank tube 332. For instance, in the third embodiment of the ink-jet printing apparatus, the flow resistance upon flowing the ink in the air buffer 349 and the sub-tank tube 321 can be greater than the flow resistance upon flowing the ink in the main tank tube 332 and the check valve 340. In this case, the flow resistance member 353 is mounted in the main tank tube 332 so that the flow resistance upon flowing the ink within the holding tank tube 326, the air buffer 349 and the sub-tank tube 321 become smaller than the flow resistance upon flowing the ink through the main tank tube 332 and the check valve 340.

By this, upon supplying the ink from the holding tank 333 to the air buffer 349, the ink amount, supplied from the holding tank 333 to the sub-tank 303 through the holding tank tube 326, the air buffer 349 and the sub-tank tube 321, is certainly greater than the ink amount to be supplied from the main tank 302 to the sub-tank 303 through the main tank tube 332. Accordingly, ink is certainly supplied from the holding tank 333 to the air buffer 349.

It should be noted that these modifications are applicable for other embodiments as required.

The liquid supply method and the liquid supply apparatus in the respective embodiments and modifications is not limited to the ink-jet printing apparatus, but is applicable for the liquid ejection printing apparatus different from the ink-jet printing apparatus. On the other hand, the present invention is applicable not only for the liquid ejection printing apparatus but also for a liquid supply to a liquid consuming member other than the ejection head portion.

Furthermore, in respective of the embodiment, ink supply is performed by sucking the ink from the fourth tank to the third tank, a construction for achieving the first object of the present invention is not limited to the construction for supplying the ink. For example, it is possible to manually pour the ink to the second ink tank directly by the user from the bottle. From the supply tank, the ink can be fed to the second or third ink tank by means of separate pumps.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A liquid ejection printing apparatus performing printing by ejecting a liquid toward a printing medium, comprising:

a liquid ejection head portion having a liquid ejecting printing head ejecting a liquid and a first tank holding the liquid to be supplied to said head;

a second tank holding a liquid to be supplied to said first tank and having an atmosphere communicating opening for introducing an atmospheric air;

a third tank receiving the liquid from said first tank and capable of supplying the liquid to said second tank;

a first liquid supply passage for communicating said first tank and said second tank;

a second liquid supply passage for communicating said second tank and said third tank;

a third liquid supply passage for communicating said third tank each to said first tank;

said first tank, and said third tank each forming an enclosed space excluding supply passages connected respectively thereto;

a pump capable of sucking a gas within said third tank provided in a passage other than said first, second and third supply passages and a first valve provided in said second supply passage for opening and closing said second liquid supply passage; and a second valve connected to said third tank for communicating the gas within said third tank to outside.

2. A liquid ejection printing apparatus as claimed in claim 1, which further comprises a carriage for reciprocally moving with mounting said liquid ejection head portion and a casing for supporting said carriage in reciprocally movable fashion, and said second tank and said third tank are fixedly provided within said casing.

3. A liquid ejection printing apparatus as claimed in claim 1, wherein said pump is a tube pump which can reduce and increase pressure in said third tank by driving in forward and reverse direction.

4. A liquid ejection printing apparatus as claimed in claim 1, which further comprises detecting means for detecting a liquid surface level within said third tank.

5. A liquid ejection printing apparatus as claimed in claim 4, wherein said liquid surface detecting means comprises a first liquid surface detecting means provided at a portion higher than an end portion of said first liquid supply passage which is on the side of the second tank, and a second liquid surface detecting means provided at a portion lower than an end portion of said third liquid supply passage which is on the side of the third tank, in which said second valve and said suction means are provided at upper portion than said first liquid surface detecting means.

6. A liquid ejection printing apparatus as claimed in claim 5, wherein said first liquid surface detecting means is provided within said second tank and said second liquid surface detecting means is provided within said third tank.

7. A liquid ejection printing apparatus as claimed in claim 5, wherein vertical positions of bottom surfaces of said second tank and said third tank are equal to each other and each of opposing ends of said second liquid supply passage are connected to the bottom surfaces of said second and third tanks, respectively, and said first and second liquid surface detecting means are provided within said third tank.

8. A liquid ejection printing apparatus as claimed in claim 1, which further comprises a fourth tank supplying a liquid to said third tank and a fourth liquid supply passage communicating said third tank and said fourth tank, and said pump is provided in the passage other than said fourth liquid supply passage.

9. A liquid ejection printing apparatus as claimed in claim 8, wherein a flow resistance upon flowing the liquid within said second tank into said third tank through said first tank and said third liquid supply passage is smaller than a flow resistance upon flowing the liquid within said fourth tank into said third ink tank via said fourth liquid supply passage.

10. A liquid ejection printing apparatus as claimed in claim 9, wherein a flow resistance member is provided within said fourth liquid supply passage.

11. A liquid ejection printing apparatus as claimed in claim 8, said third liquid passage is provided with a third valve or blocking movement of the liquid.

12. A liquid supply method for supplying a liquid to the liquid ejection printing apparatus as defined in claim 11, comprising:

a first liquid supply step of closing said first and second valves and sucking a gas within said third tank for introducing the liquid within said first tank into said third tank;

a second liquid supply step of opening said first and second valves and introducing the liquid within said third tank into said second tank; and a third liquid supply step of closing said first, second and third valves, sucking a gas within said third tank by said pump and introducing the liquid within said fourth tank into said third tank.

13. A liquid supply method as claimed in claim 12, wherein said third liquid supply step is performed during printing operation to said printing medium.

14. A liquid supply method as claimed in claim 12, wherein said pump can reduce and increase pressure within said third tank; and which further comprises fourth liquid supply step of closing said second and third valves, opening said first valve and introducing a liquid within said third tank into said second tank through said second liquid supply passage by pressurizing the third tank by said pump.

15. A liquid ejection printing apparatus as claimed in claim 1, wherein said first valve is a check valve permitting movement of the liquid from said third tank to said second tank.

16. A liquid ejection printing apparatus as claimed in claim 1, further comprising a capping member which can contact and release with a nozzle surface of said liquid ejection head, and a pressure adjusting valve for adjusting a pressure within a space formed by said nozzle surface of said head and said capping member.

17. A liquid ejection printing apparatus as claimed in claim 1, which further comprises a fourth valve for blocking a communicating portion between said liquid ejection head of said head portion and said first tank.

18. A liquid ejection printing apparatus as claimed in claim 1, wherein said printing head is provided with an electrothermal transducer generating a thermal energy utilized for ejection of the liquid.

19. A liquid supply method for supplying a liquid to a liquid ejection printing apparatus as defined in claim 1, comprising:

a first liquid supply step of closing said first and second valves and sucking a gas of said third tank by said pump for introducing a liquid within said first tank to said third tank; and a second liquid supply step of opening said first and second valves for introducing the liquid within said third tank to said second tank.

20. A liquid supply method as claimed in claim 19, wherein, on the basis of a result of detection of the liquid detecting means for detecting a liquid surface of said third tank, said first liquid supply step is stopped and said second liquid supply step is performed.

* * * * *

UNITED STATES PATENT AND TRADEMARK OFFICE

CERTIFICATE OF CORRECTION

PATENT NO. : 6,082,851
DATED : July 4, 2000
INVENTOR(S) : Shihoh et al.

It is certified that error appears in the above-identified patent and that said Letters Patent is hereby corrected as shown below:

Column 2,
Line 5, “enclosed” should read -- an enclosed --;
Line 16, “discharge” should read -- discharged --;
Line 20, “view point” should read -- viewpoint --;
Line 38, “perform” should read -- performing --; and
Line 59, “supplying” should read -- supply --.

Column 4,
Line 8, “respective” should read -- perspective --.

Column 6,
Line 22, “a” should read -- an --;
Line 30, “rotatably” should read -- rotation --; and
Line 35, “extend” should read -- extends --.

Column 9,
Line 55, “member” should read -- member which --.

Column 10,
Line 8, “as” should read -- As --; and
Line 8, “In place,” should be deleted.

Column 11,
Line 36, “quickly” should read -- quick --;
Line 50, “is performed” should be deleted;
Line 51, “by” should read -- and by --; and
Line 63, “returning” should read -- by returning to --.

Column 12,
Line 23, “maintain” should read -- maintaining --;
Line 31, “detect” should read -- detects --; and
Line 51, “operation,” should read -- operations, --.

Column 14,
Line 6, “open” should read -- are open --;
Line 7, “condition” should read -- condition of --; and “At” should read -- In --;
Line 10, “ink” should read -- an ink --;
Line 49, “provided” should read -- be provided --; and
Line 65, “us” should read -- is --.

UNITED STATES PATENT AND TRADEMARK OFFICE

CERTIFICATE OF CORRECTION

PATENT NO. : 6,082,851
DATED : July 4, 2000
INVENTOR(S) : Shihoh et al.

It is certified that error appears in the above-identified patent and that said Letters Patent is hereby corrected as shown below:

Column 15,
Line 19, “ends” should read -- end --; and
Line 47, “to” should be deleted.

Column 16,
Line 4, “form” should read -- from --; and
Line 42, “BY” should read -- By --.

Column 17,
Line 14, “becomes” should read -- become a --.

Column 18,
Line 67, “own” should read -- the --.

Column 19,
Line 15, “S2111),” should read -- S211), --;
Line 57, “illustration” should read -- illustrated --; and
Line 61, “height” should read -- the height --.

Column 20,
Line 4, “allow U” should read -- arrow U --.

Column 21,
Line 31, “in” should read -- ink --;
Line 36, “large amount” should read -- a large amount of --;
Line 38, “mechanism” should read -- a mechanism --;
Line 42, “s” should read -- a --; and
Line 63, “in-jet” should read -- ink-jet --.

Column 22,
Line 6, “flow” should read -- flown --; and
Line 58, “number” should read -- a number --

Column 23,
Line 20, “system” should read -- system of the --.

UNITED STATES PATENT AND TRADEMARK OFFICE

CERTIFICATE OF CORRECTION

PATENT NO. : 6,082,851
DATED : July 4, 2000
INVENTOR(S) : Shihoh et al.

It is certified that error appears in the above-identified patent and that said Letters Patent is hereby corrected as shown below:

Column 24,
Line 1, "of the embodiment," should read -- embodiments, --.

Signed and Sealed this

Thirtieth Day of July, 2002

*Attest:*

*Attesting Officer*

JAMES E. ROGAN
*Director of the United States Patent and Trademark Office*